US006736900B2

(12) United States Patent
Isogai et al.

(10) Patent No.: US 6,736,900 B2
(45) Date of Patent: May 18, 2004

(54) HIGHLY-VISCOUS-FLUID APPLYING APPARATUS CAPABLE OF CONTROLLING DELIVERY AMOUNT OF FLUID

(75) Inventors: Takeyoshi Isogai, Hekinan (JP); Hiroshi Katsumi, Chiryu (JP); Toshihiko Yamasaki, Nisshin (JP)

(73) Assignee: Fuji Machine Mfg. Co., Ltd., Chiryu (JP)

( * ) Notice: Subject to any disclaimer, the term of this patent is extended or adjusted under 35 U.S.C. 154(b) by 170 days.

(21) Appl. No.: 10/006,380

(22) Filed: Dec. 10, 2001

(65) Prior Publication Data

US 2002/0071772 A1 Jun. 13, 2002

(30) Foreign Application Priority Data

Dec. 13, 2000 (JP) ..... 2000-379103
Jan. 9, 2001 (JP) ..... 2001-001983

(51) Int. Cl.[7] ..... B05C 11/00

(52) U.S. Cl. ..... 118/663; 118/315; 118/323; 118/683; 222/413; 222/61; 222/146.2; 222/373; 222/399; 239/130; 239/139; 239/337; 239/373; 239/135

(58) Field of Search ..... 118/688, 315, 118/323, 663, 52; 222/413, 61, 168, 146.2, 321.2, 373, 375, 399; 239/130, 139, 337, 373, 456, 550, 554, 565, 135

(56) References Cited

U.S. PATENT DOCUMENTS 2,976,392 A * 3/1961 Wabnitz ..... 392/495
5,046,666 A * 9/1991 Ono ..... 239/73
5,564,606 A * 10/1996 Engel ..... 222/261
5,819,983 A * 10/1998 White et al. ..... 222/413

FOREIGN PATENT DOCUMENTS

JP B2 2863475 12/1998
WO WO 99/49987 * 10/1999 ..... B05C/5/02

* cited by examiner

*Primary Examiner*—Richard Crispino
*Assistant Examiner*—Michelle Acevedo Lazor
(74) *Attorney, Agent, or Firm*—Oliff & Berridge, PLC

(57) ABSTRACT

A highly-viscous-fluid applying apparatus including a fluid supply device operable to supply a highly viscous fluid, a delivery nozzle from which the highly viscous fluid is delivered, a pump disposed between the fluid supply device and the delivery nozzle and operable to feed the highly viscous fluid received from the fluid supply device, to the delivery nozzle, and a pump control device operable to control the pump, for controlling an amount of delivery of the highly viscous fluid to be delivered from the delivery nozzle.

23 Claims, 20 Drawing Sheets

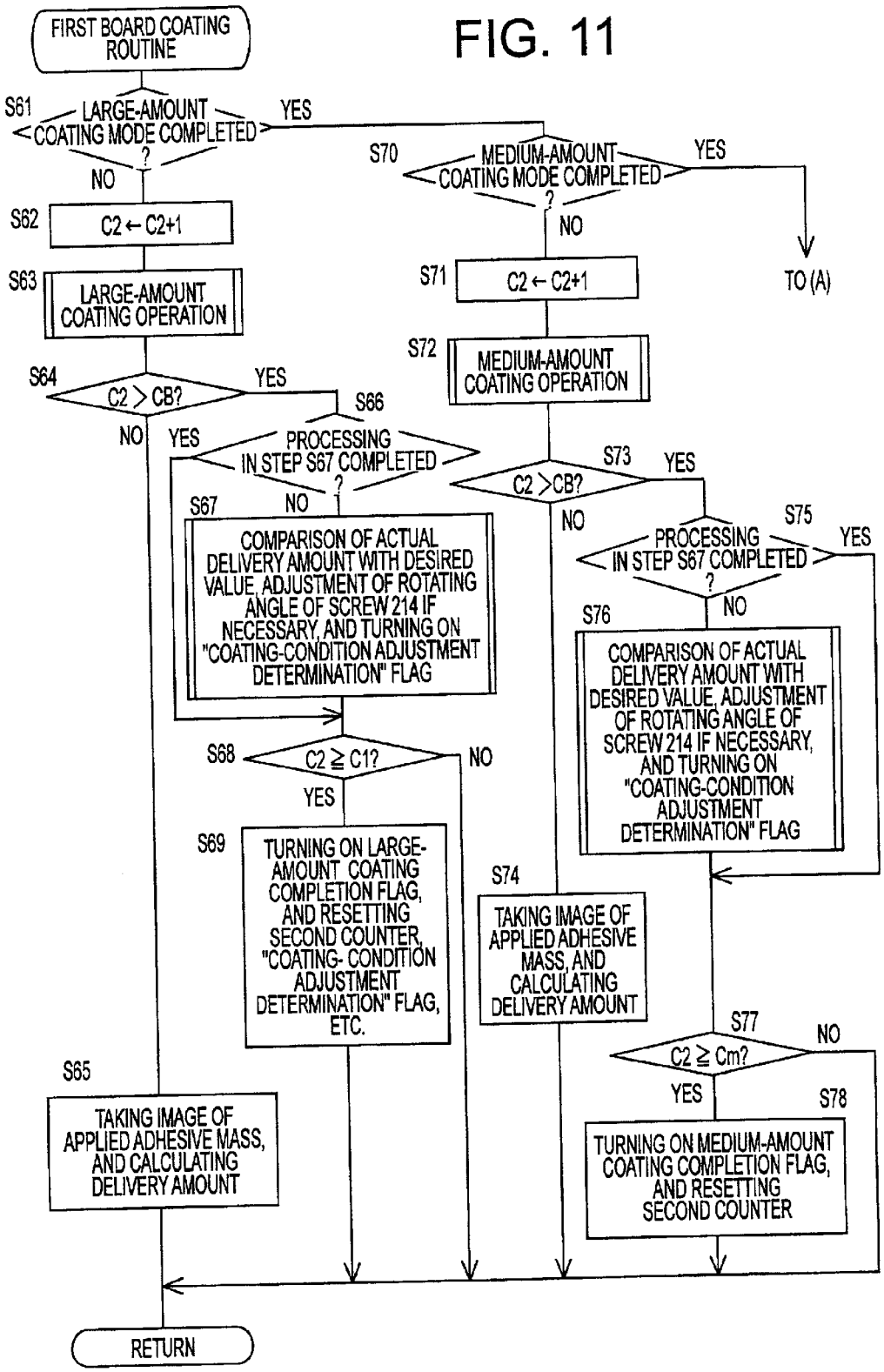
FIRST BOARD COATING ROUTINE
FIG. 11
S61
LARGE-AMOUNT COATING MODE COMPLETED ?
YES
NO
S62
C2 ← C2+1
S63
LARGE-AMOUNT COATING OPERATION
S64
C2 > CB?
YES
NO
S66
PROCESSING IN STEP S67 COMPLETED ?
YES
NO
S67
COMPARISON OF ACTUAL DELIVERY AMOUNT WITH DESIRED VALUE, ADJUSTMENT OF ROTATING ANGLE OF SCREW 214 IF NECESSARY, AND TURNING ON "COATING-CONDITION ADJUSTMENT DETERMINATION" FLAG
S68
C2 ≧ C1?
YES
NO
S69
TURNING ON LARGE-AMOUNT COATING COMPLETION FLAG, AND RESETTING SECOND COUNTER, "COATING- CONDITION ADJUSTMENT DETERMINATION" FLAG, ETC.
S65
TAKING IMAGE OF APPLIED ADHESIVE MASS, AND CALCULATING DELIVERY AMOUNT
RETURN
S70
MEDIUM-AMOUNT COATING MODE COMPLETED ?
YES
NO
TO (A)
S71
C2 ← C2+1
S72
MEDIUM-AMOUNT COATING OPERATION
S73
C2 > CB?
YES
NO
S75
PROCESSING IN STEP S67 COMPLETED ?
YES
NO
S76
COMPARISON OF ACTUAL DELIVERY AMOUNT WITH DESIRED VALUE, ADJUSTMENT OF ROTATING ANGLE OF SCREW 214 IF NECESSARY, AND TURNING ON "COATING-CONDITION ADJUSTMENT DETERMINATION" FLAG
S74
TAKING IMAGE OF APPLIED ADHESIVE MASS, AND CALCULATING DELIVERY AMOUNT
S77
C2 ≧ Cm?
YES
NO
S78
TURNING ON MEDIUM-AMOUNT COATING COMPLETION FLAG, AND RESETTING SECOND COUNTER

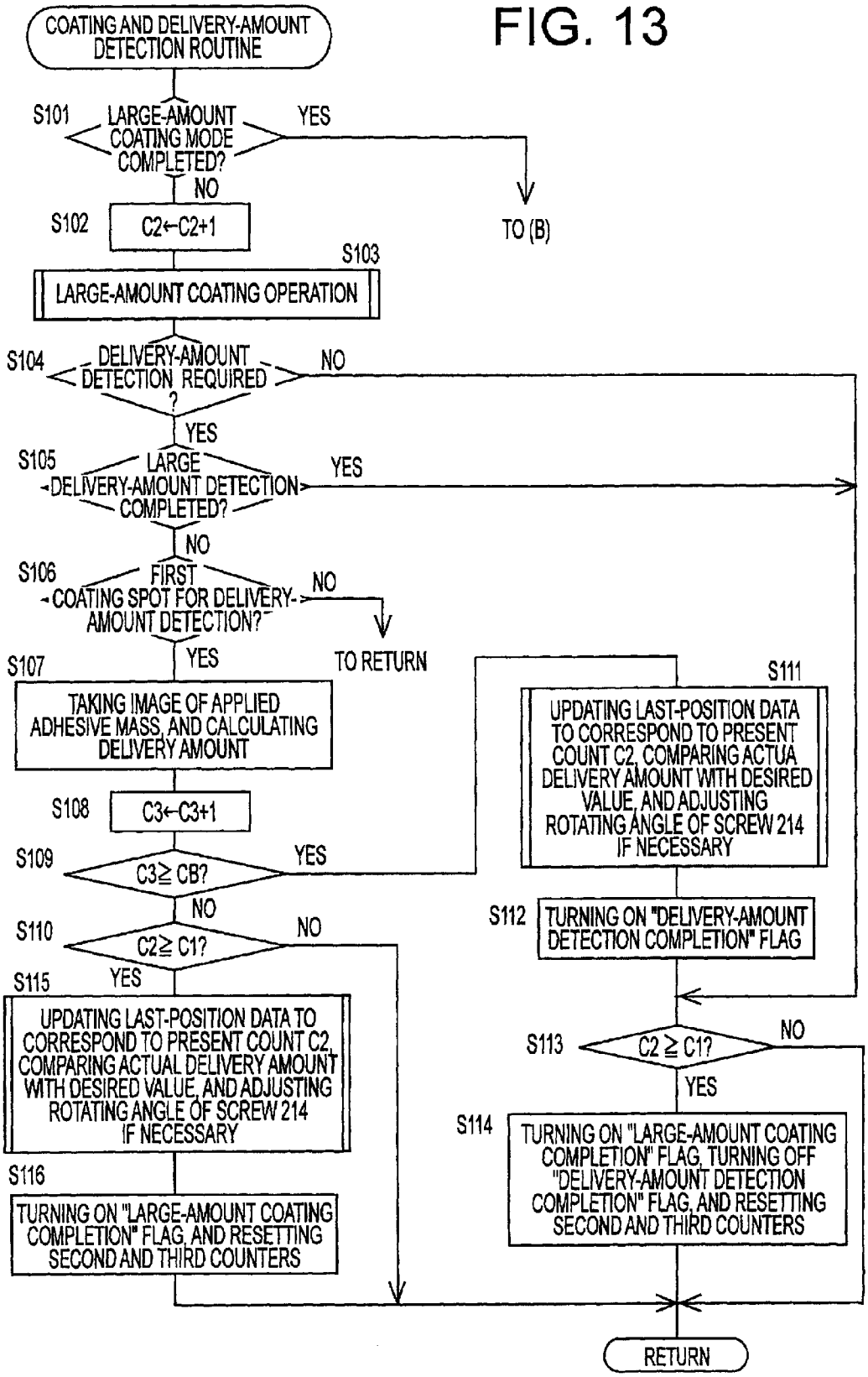
FIG. 13
COATING AND DELIVERY-AMOUNT DETECTION ROUTINE
S101
LARGE-AMOUNT COATING MODE COMPLETED?
YES
TO (B)
NO
S102
C2←C2+1
S103
LARGE-AMOUNT COATING OPERATION
S104
DELIVERY-AMOUNT DETECTION REQUIRED ?
NO
YES
S105
LARGE DELIVERY-AMOUNT DETECTION COMPLETED?
YES
NO
S106
FIRST COATING SPOT FOR DELIVERY-AMOUNT DETECTION?
NO
TO RETURN
YES
S107
TAKING IMAGE OF APPLIED ADHESIVE MASS, AND CALCULATING DELIVERY AMOUNT
S108
C3←C3+1
S109
C3≧CB?
YES
NO
S110
C2≧C1?
NO
YES
S115
UPDATING LAST-POSITION DATA TO CORRESPOND TO PRESENT COUNT C2, COMPARING ACTUAL DELIVERY AMOUNT WITH DESIRED VALUE, AND ADJUSTING ROTATING ANGLE OF SCREW 214 IF NECESSARY
S116
TURNING ON "LARGE-AMOUNT COATING COMPLETION" FLAG, AND RESETTING SECOND AND THIRD COUNTERS
S111
UPDATING LAST-POSITION DATA TO CORRESPOND TO PRESENT COUNT C2, COMPARING ACTUA DELIVERY AMOUNT WITH DESIRED VALUE, AND ADJUSTING ROTATING ANGLE OF SCREW 214 IF NECESSARY
S112
TURNING ON "DELIVERY-AMOUNT DETECTION COMPLETION" FLAG
S113
C2≧C1?
NO
YES
S114
TURNING ON "LARGE-AMOUNT COATING COMPLETION" FLAG, TURNING OFF "DELIVERY-AMOUNT DETECTION COMPLETION" FLAG, AND RESETTING SECOND AND THIRD COUNTERS
RETURN

FIG. 18

356

RAM

| | |
|---|---|
| DELIVERY-AMOUNT DETECTION MODE MEMORY | CONTROL PROGRAM MEMORY |
| LARGE DELIVERY-AMOUNT MEMORY | COATING POINT-NUMBER MEMORY |
| MEDIUM DELIVERY-AMOUNT MEMORY | DELIVERY AMOUNT MEMORY |
| SMALL DELIVERY-AMOUNT MEMORY | COATING CONDITION ADJUSTMENT DETERMINATION FLAG |
| LAST LARGE-AMOUNT DETECTING POSITION MEMORY | DELIVERY-AMOUNT DETECTION COMPLETION FLAG |
| LAST MEDIUM-AMOUNT DETECTING POSITION MEMORY | FLAG F1 |
| LAST SMALL-AMOUNT DETECTING POSITION MEMORY | FIRST COUNTER |
| FIRST COATING COMPLETION FLAG | SECOND COUNTER |
| SECOND COATING COMPLETION FLAG | THIRD COUNTER |
| DELIVERY-AMOUNT DETECTION FLAG | |
| LARGE-AMOUNT COATING COMPLETION FLAG | |
| MEDIUM-AMOUNT COATING COMPLETION FLAG | |

HIGHLY-VISCOUS-FLUID APPLYING APPARATUS CAPABLE OF CONTROLLING DELIVERY AMOUNT OF FLUID

This application is based on Japanese Patent Application No. 2000-379103 filed on Dec. 13, 2000 and No. 2001-001983 filed on Jan. 9, 2001, the contents of which are incorporated hereinto by reference.

BACKGROUND OF THE INVENTION

1. Field of the Invention

The present invention relates to a highly-viscous-fluid applying apparatus for applying a highly viscous fluid to an object, and more particularly to a technique for controlling an amount of the fluid to be applied to the object.

2. Discussion of Related Art

JP-B2-2863475 discloses an example of a highly-viscous-fluid applying or applying apparatus in the form of an adhesive applying apparatus arranged to apply a highly viscous fluid in the form of an adhesive agent to a circuit substrate in the form of a printed-wiring board. In this adhesive applying apparatus, the adhesive agent is accommodated in a syringe, and is extruded from the syringe with a compressed air introduced into the syringe, so that a suitable amount of the adhesive agent is applied to predetermined fluid-applying spots on the printed-wiring board. The amount of delivery of the adhesive agent from the syringe can be changed by adjusting the time of introduction of the compressed air into the syringe or the pressure of the compressed air. In view of this fact, the fluid applying apparatus disclosed in the above-identified publication is arranged to operate an image-taking device to taken an image of a mass of adhesive agent applied to the printed-wiring board, obtain an amount of the applied adhesive agent, on the basis of image data representative of the image, compare the obtained amount with a reference value, and adjust the time of introduction or pressure of the compressed air. If the obtained amount of the applied adhesive agent is smaller than the reference value by more than a predetermined amount, the time of introduction or pressure of the compressed air is increased. If the amount of the applied adhesive agent is larger than the reference value by more than a predetermined amount, the time of introduction or pressure of the compressed air is reduced. Thus, the amount of the adhesive agent to be delivered from the syringe to the printed-wiring board is suitably controlled.

Since the air is compressible, however, it is difficult to accurately control the amount of delivery of the adhesive agent by adjusting the time of introduction or pressure of the compressed air. Namely, the amount of delivery of the adhesive agent from the syringe does not change accurately in proportion with an amount of change of the time of introduction or pressure of the compressed air, due to compression of the compressed air. The difficulty to control the amount of delivery of the adhesive agent from the syringe increases with a decrease in the amount of the adhesive agent left in the syringe and a consequent increase in the amount of the compressed air in the syringe.

SUMMARY OF THE INVENTION

It is therefore an object of the present invention to provide a highly-viscous-fluid applying apparatus, which permits an accurate control of the amount of delivery of the adhesive agent. This object may be achieved according to any one of the following modes of the present invention, each of which is numbered like the appended claims and depends from the other mode or modes, where appropriate, to indicate and clarify possible combinations of elements or technical features. It is to be understood that the present invention is not limited to the technical features or any combinations thereof which will be described for illustrative purpose only. It is to be further understood that a plurality of elements or features included in any one of the following modes of the invention are not necessarily provided all together, and that the invention may be embodied without some of the elements or features described with respect to the same mode.

(1) A highly-viscous-fluid applying apparatus comprising:

a fluid supply device operable to supply a highly viscous fluid;

a delivery nozzle from which the highly viscous fluid is delivered;

a pump disposed between the fluid supply device and the delivery nozzle, and operable to feed the highly viscous fluid received from the fluid supply device, to the delivery nozzle;

and a pump control device operable to control the pump, for controlling an amount of delivery of the highly viscous fluid to be delivered from the delivery nozzle.

The highly viscous fluid to be delivered from the present delivery nozzle of the highly-viscous-fluid applying apparatus may be an adhesive agent, or a solder paste or cream. The pump may be a screw pump or a gear pump.

The highly viscous fluid supplied from the fluid supply device is fed by the pump to the delivery nozzle, from which the fluid is delivered onto an object. The amount of the highly viscous fluid to be fed from the pump to the delivery nozzle is substantially proportional to the operating amount of the pump, without an influence of the compressibility of compressed air conventionally used to feed the fluid. Accordingly, the amount of the fluid to be delivered from the delivery nozzle can be accurately controlled by controlling the pump with the pump control device.

(2) A highly-viscous-fluid applying apparatus according to the above mode (1), wherein the pump is a screw pump including a pump housing having a screw chamber having a circular shape in transverse cross section, the screw pump further including a screw which is substantially fluid-tightly disposed within the pump housing such that the screw and the pump housing are rotatable relative to each other, the pump control device including a pump drive device operable to rotate the pump housing and the screw relative to each other.

With the relative rotation of the pump housing and the screw, the highly viscous fluid is fed from the screw chamber and delivered through the delivery nozzle. Since the fluid has a relatively high degree of viscosity, the relative rotation of the pump housing and the screw will cause the fluid to be fed along a helical thread of the screw. The screw is substantially fluid-tightly disposed within the screw chamber, so that the fluid is substantially prevented from flowing in the reverse direction through a gap between the screw and the inner circumferential surface of the pump housing which defines the screw chamber. Accordingly, the amount of the fluid to be fed in the forward direction from the screw chamber toward the delivery nozzle is substantially proportional to the angle of relative rotation of the pump housing and the screw. By controlling the angle of the relative rotation, therefore, the amount of delivery of the fluid from the delivery nozzle can be controlled with high accuracy. Further, the diameter of the screw pump may be easily made relatively small, so that the screw pump can be disposed relatively near the delivery nozzle.

(3) A highly-viscous-fluid applying apparatus according to the above mode (2), wherein the pump housing is stationary, while the screw is rotated within the pump housing, by the pump drive device.

(4) A highly-viscous-fluid applying apparatus according to the above mode (2), wherein the screw is stationary, while the pump housing is rotated about the screw, by the pump drive device.

(5) A highly-viscous-fluid applying apparatus according to any one of the above modes (2)–(4), wherein the delivery nozzle extends from one end of the screw pump, coaxially with the screw pump.

In the above mode (5), the highly viscous fluid is fed by the screw pump in its axial direction to the delivery nozzle, and is delivered from the delivery nozzle in the same axial direction. Since the direction of feeding of the fluid is not changed, the fluid does not suffer from a flow resistance due to the change of the feeding direction, permitting an easy, smooth movement of the fluid from the screw pump to the delivery nozzle, so that the amount of delivery of the fluid from the delivery nozzle onto the object can be controlled with high accuracy.

(6) A highly-viscous-fluid applying apparatus according to any one of the above modes (1)–(5), wherein the fluid supply device is a fluid supply device of a pressurizing type arranged to pressurize the highly viscous fluid and feed the pressurized highly viscous fluid to the pump.

The fluid supply device is preferably arranged to supply the highly viscous fluid to the pump through a supply passage such that the pump and the supply passage are filled with the fluid, without air cavities left in the pump and supply passage. Where the fluid supply device is of a non-pressurizing type, consisting solely of a container accommodating a mass of the fluid and a supply passage connecting the container and the pump, the container is required to be located at a level higher than that of the pump. Where the fluid has a relatively high degree of viscosity, the fluid supply device is preferably of the pressurizing type arranged to pressurize the highly viscous fluid so that the pressurized fluid is fed to the pump.

In the above mode (6), the fluid can be delivered from the delivery nozzle onto the object while the pump and the supply passage connected to the pump are filled with the fluid, without air cavities left in the pump and supply passage, even where the container is located below the pump, and/or where the fluid has a considerably high degree of viscosity.

(7) A highly-viscous-fluid applying apparatus according to the above mode (6), wherein the fluid supply device of the pressurizing type includes:

- a container accommodating a mass of the highly viscous fluid;
- a compressed-air supply device operable to introduce a compressed air into an upper air chamber in the container; and
- a supply passage connecting a lower end of the container and a first end portion of the screw pump opposite to a second end portion of the screw pump from which the delivery nozzle extends.

(8) A highly-viscous-fluid applying apparatus according to any one of the above modes (2), (3) and (5)–(7), further comprising:

- a screw rotating device including a rotary shaft for rotating the screw of the screw pump;
- a sealing device interposed between the rotary shaft and the pump housing, to maintain fluid tightness therebetween while allowing rotation of the rotary shaft.

The supply passage provided in the above mode (7) is communicated with a portion of the pump housing which is located on one side of the sealing device provided in the above mode (8), which is nearer to the delivery nozzle. The supply passage may include an annular space defined by and between the outer circumferential surface of the rotary shaft and the inner circumferential surface of the pump housing. Alternatively, the supply passage may be formed to be open in the inner circumferential surface of the pump housing, at one end portion of the pump remote from the delivery nozzle.

In the above mode (8) wherein the seating device is interposed between the rotary shaft and the pump housing, the fluid is prevented from being moved in the reverse direction toward the screw rotating device, through a gap between the outer circumferential surface of the rotary shaft and the inner circumferential surface of the pump housing. Accordingly, the highly viscous fluid can be applied to the object, by an amount which is substantially proportional to the angle of rotation of the screw.

(9) A highly-viscous-fluid applying apparatus according to the above mode (4), wherein the fluid supply device includes a container for accommodating a mass of the highly viscous fluid, the container including a supply portion having an opening from which the highly viscous fluid is supplied, and the screw is fixed to the supply portion of the container.

(10) A highly-viscous-fluid applying apparatus according to the above mode (9), wherein the supply portion of the container consists of a cylindrical portion extending from one end a body of the container, and the screw is fixedly fitted at a proximal end thereof in a first part of the cylindrical portion, the opening being formed through a second part of the cylindrical portion which is located nearer to the body of the container than the first part.

(11) A highly-viscous-fluid applying apparatus according to the above mode (9) or (10), further comprising a machine frame, and wherein the pump housing is held by the machine frame such that the pump housing is rotatable and is not axially movable relative to the machine frame, and the container is removably mounted on the machine frame such that the screw is fitted into the pump housing when the container is mounted on the machine frame, and is removed from the pump housing when the container is removed from the machine frame.

(12) A highly-viscous-fluid applying apparatus according to any one of the above modes (9)–(11), further comprising a machine frame and a nozzle holding member mounted on the machine frame, and wherein the deliver nozzle is rotatably held by the nozzle holding member.

(13) A highly-viscous-fluid applying apparatus according to any one of the above modes (9)–(11), further comprising a machine frame, and wherein the pump housing and the delivery nozzle are rotatably held by the machine frame, and the pump housing is rotatably fitted in the delivery nozzle.

(14) A highly-viscous-fluid applying apparatus according to the above mode (12) or (13), further comprising a nozzle rotating device operable to rotate the delivery nozzle relative to the container and the machine frame.

(15) A highly-viscous-fluid applying apparatus according to any one of the above modes (1)–(14), further comprising a delivery-amount detecting device operable to detect an amount of delivery of the highly viscous fluid from the delivery nozzle onto an object, and the pump control device controls the pump such that the amount of delivery of the highly viscous fluid detected by the delivery-amount detecting device is adjusted to a desired value.

The amount of delivery of the highly viscous fluid from the delivery nozzle may be detected on the basis of an outside diameter or outer size, a surface area of an outer profile, a height dimension or a volume of a mass of the fluid applied onto the object, or a combination of those parameters. Although the delivery amount can be detected with highest accuracy on the basis of the volume of the applied fluid mass, it is possible to estimate the volume of the applied fluid mass on the basis of at least one of the outside diameter, surface area and height dimension of the fluid mass. The pump control device may be arranged to control the pump such that at least one of those detected parameters coincides with a desired value. The delivery-amount detecting device preferably uses an image-taking device, but may use a height detecting device using a laser beam or a ultrasonic wave. The image-taking device may be arranged to take a two-dimensional image of the applied fluid mass in a direction perpendicular to the working surface of the object. Alternatively, the volume of the applied fluid mass may be obtained by an image-taking system as disclosed in co-pending U.S. patent application Ser. No. 09/634,257 filed Aug. 7, 2000. This image-taking system includes a light-source device or an illuminating device and a two-dimensional image-taking device. The light-source device is arranged to emit a planar light along a straight plane, while the image-taking device is disposed such that its optical axis intersects the plane of the planar light. Two-dimensional images of the applied fluid mass are taken by the image-taking device, at different positions during movements of the light-source device and the image-taking device relative to the object. Image data representative of these two-dimensional images are processed to obtain a three-dimensional geometry of the applied fluid mass, which consists of two-dimensional profiles taken in different cross sectional planes perpendicular to the working surface. In the above mode (15), the amount of delivery of the fluid from the delivery nozzle can be automatically controlled with high accuracy, on the basis of the detected actual amount.

(16) A highly-viscous-fluid applying apparatus according to any one of the above modes (1)–(15), further comprising a gap-defining portion which is disposed so as to extend in a direction of extension of the delivery nozzle, in the vicinity of the delivery nozzle as seen in a direction perpendicular to the above-indicated direction of extension, such that a free end of the gap-defining portion is located ahead of a free end of the delivery nozzle in the direction of extension and such that the gap-defining portion is moved with the delivery nozzle in the direction of extension, for abutting contact with a working surface of an object, to maintain a predetermined gap between the free end of the gap-defining portion and the working surface.

Where, the delivery nozzle consists of a nozzle body and at least one delivery tube extending from the nozzle body, the gap-defining portion may be a pin which extends from the nozzle body in parallel with the at least one delivery tube, so that the pin comes into abutting contact its free end with the working surface of the object when the delivery nozzle is moved toward the object. Where the delivery tube has a high degree of rigidity, the gap-defining portion which is L-shaped or U-shaped may be fixed to the delivery tube. For instance, the L-shaped gap-defining portion consisting of a short arm and a long arm is fixed to the delivery tube such that the delivery tube extends through the short art of the L-shaped gap-defining portion. Alternatively, the U-shaped gap-defining portion is fixed to the delivery tube such that the delivery tube extends through the bottom of the U-shaped gap-defining portion. The gap-defining portion need not be an integral part of the delivery nozzle, but may be a separate member. The gap-defining portion may be fixed to the delivery nozzle which is removably held by a nozzle holder. Alternatively, the gap-defining portion may be fixedly disposed on a member which carries the delivery nozzle and which is moved to move the delivery nozzle in a direction perpendicular to the working surface of the object when the fluid is applied onto the object.

The highly viscous fluid is delivered onto the working surface of the object while the predetermined gap is maintained between the free end or delivery end of the delivery nozzle and the working surface. This arrangement permits a high degree of consistency in the three-dimensional configuration or geometry of the fluid mass applied to the working surface of the object.

The gap-defining portion may also function as a stop for determining the position of the delivery nozzle with respect to the working surface of the object in the direction perpendicular to the working surface. This stop prevents an abutting contact of the delivery nozzle at its delivery end with the object, protecting the delivery tube or tubes of the delivery nozzle against bending or other damage due to an impact upon the abutting contact, even where the diameter of the delivery tube or tubes is relatively small.

(17) A highly-viscous-fluid applying apparatus according to the above mode (16), further comprising a machine frame, a biasing device and a stopper device, and wherein at least the delivery nozzle and the gap-defining portion are movable relative to the machine frame in an axial direction of the delivery nozzle, and are biased by the biasing device in the axial direction from a proximal end toward a delivery end of the delivery nozzle, the gap-defining portion and the delivery nozzle being normally held under a biasing action of the biasing device, at respective positions which are determined by the stopper device.

In the above mode (17) of this invention, the delivery nozzle and the gap-defining portion may be moved a relatively short distance relative to the machine frame against a biasing force of the biasing device, even after the gap-defining portion has come into abutting contact with the working surface of the object. This arrangement permits the gas-defining portion to be brought into abutting contact with the object, with a high degree of stability, for establishing the predetermined gap between the delivery end of the delivery nozzle and the working surface of the object. In addition, the biasing device functions to reduce the impact upon the abutting contact of the gap-defining portion with the object, protecting the gap-defining portion and the object against damage due to the abutting contact.

(18) A highly-viscous-fluid applying apparatus according to the above mode (17), wherein the pump includes a pump housing, and the pump housing and the delivery nozzle are not movable relative to each other and are movable together relative to the machine frame in the axial direction of the delivery nozzle.

When the delivery nozzle is axially moved relative to the machine frame, the pump housing is moved with the delivery nozzle relative to the machine frame, so that the pump housing is held in an operating state in which the highly viscous fluid is fed from the pump housing to the delivery nozzle.

(19) A highly-viscous-fluid applying apparatus according to any one of the above modes (1)–(18), further comprising a temperature control device operable to control a temperature of a mass of the highly viscous fluid, at least at a portion of the mass which is moved through the delivery nozzle for delivery thereof onto an object.

In the above mode (19), the temperature of the highly viscous fluid can be controlled to a level suitable for delivery onto the object, making it possible to control the viscosity of the fluid suitable for delivery onto the object, so that the amount of delivery of the fluid onto the object can be controlled with high accuracy.

(20) A highly-viscous-fluid applying apparatus according to the above mode (19), wherein the pump includes a pump housing and a screw disposed within the pump housing such that the screw and the pump housing are rotatable relative to each other, and the temperature control device has:

a gas passage through which a gas is circulated for heat transfer between the gap and a portion of the pump housing which surrounds the screw; and a gas-temperature control device operable to control a temperature of the gas is circulated through the gas passage.

The gas passage may be formed such that the gas is circulated for direct contact with the portion of the pump housing surrounding the screw, or for indirect contact with that portion via other member or members. Where the gas passage is formed for indirect contact of the gas with the above-indicated portion of the pump housing, it is desirable to arrange the relevant portion of the apparatus such that the heat transfer is effected between the gas and the above-indicated portion, through thermal conduction therebetween.

The gas-temperature control device includes a heating device and a cooling device for heating and cooling the gas, for example. The temperature of the gas may be controlled to be equal to a desired temperature of the highly viscous fluid, or to be higher or lower than this desired temperature.

The highly viscous fluid is heated or cooled by the gas circulated through the gas passage, so that the temperature of the fluid is controlled to a level suitable for delivery onto the object.

(21) A highly-viscous-fluid applying apparatus according to any one of the above modes (1)–(20), wherein the delivery nozzle has a plurality of delivery tubes parallel to each other.

In the above mode (21), two or more masses of the highly viscous fluid are concurrently applied through the respective delivery tubes to respective fluid-applying spots on the object, when the screw is rotated relative to the pump housing, when the delivery nozzle is located at each coating position.

(22) A highly-viscous-fluid applying apparatus according to the above mode (21), further comprising a nozzle rotating device operable to rotate the delivery nozzle about an axis thereof which is parallel to the plurality of delivery tubes.

In the above mode (22) wherein the nozzle is rotated about its axis, the fluid-applying spots on the object which correspond to each coating position of the delivery nozzle can be moved about the axis of the delivery nozzle.

(23) A highly-viscous-fluid applying apparatus according to the above mode (22), further comprising a controller operable to control the nozzle rotating device according to a predetermined control program.

(24) A highly-viscous-fluid applying apparatus according to any one of the above modes (1)–(23), further comprising a support member, and a relative-movement device operable to move the support member and an object relative to each other in a direction parallel to a working surface of the object on which the highly viscous fluid is delivered from the delivery nozzle, and in a direction perpendicular to the working surface.

(25) A highly-viscous-fluid applying apparatus according to claim 1, wherein the fluid supply device is a fluid supply device of a pressurizing type arranged to pressurize the highly viscous fluid and feed the pressurized highly viscous fluid to the pump, the apparatus further comprising a synchronous controller operable to operate the fluid supply device of the pressurizing type, in synchronization with an operation of the pump under the control of the pump control device.

(26) A highly-viscous-fluid applying apparatus according to any one of the above modes (1)–(25), wherein the pump control device includes a reverse-operating portion operable to operate the pump by a predetermined amount in a reverse direction opposite to a forward direction after termination of an operation of the pump in the forward direction to feed the highly viscous fluid to the delivery nozzle.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which:

FIGS. 11 and 12 are flow charts illustrating a first-board coating routine executed according to a control program stored in the RAM;

FIGS. 13–15 are flow charts illustrating a coating and adhesive delivery-amount detecting routine executed according to a control program stored in the RAM;

FIG. 18 is a block diagram schematically indicating an arrangement of the RAM of the computer;

DETAILED DESCRIPTION OF THE PREFERRED EMBODIMENTS

Figure 1:
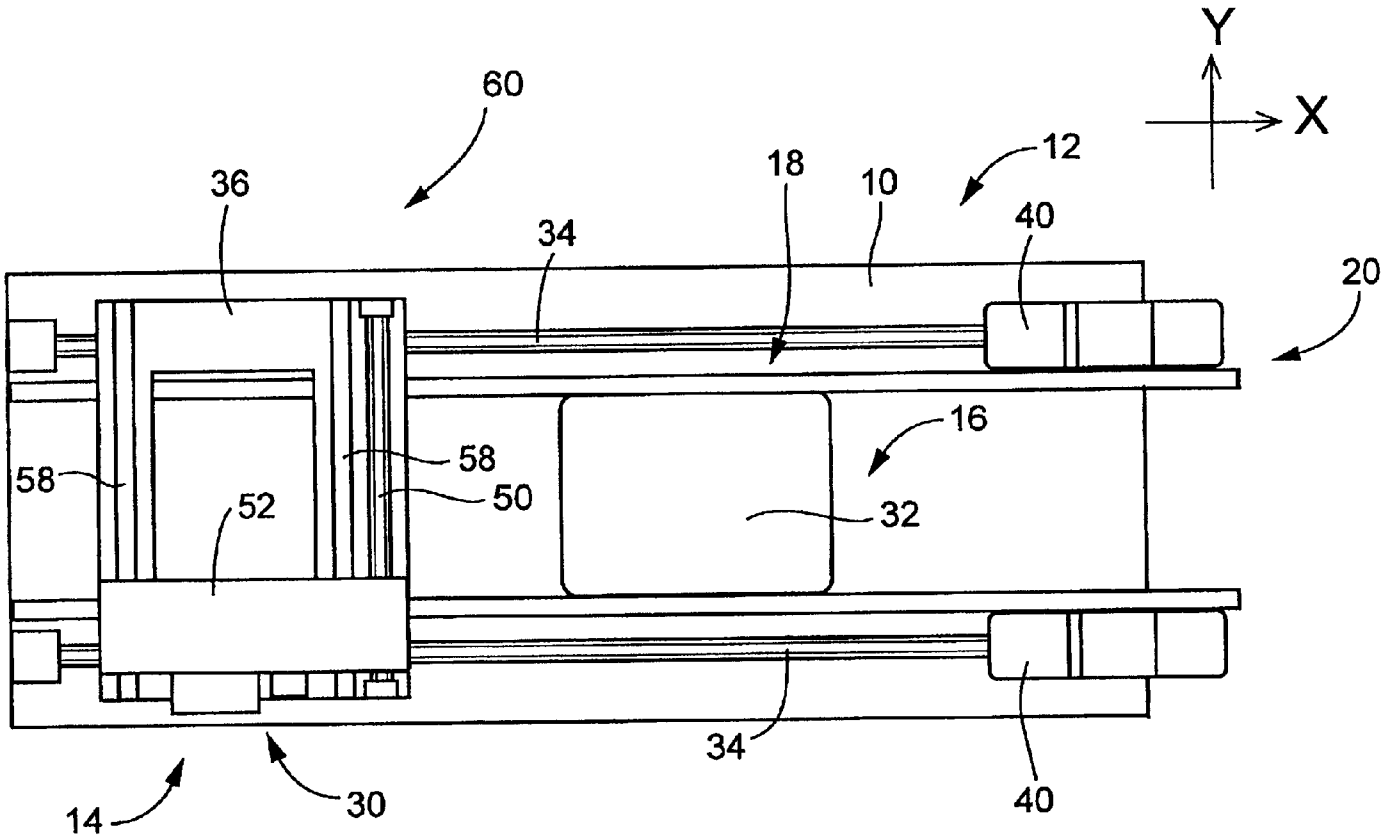
FIG. 1 is a plan view schematically showing an adhesive applying system including an adhesive applying apparatus constructed according to one embodiment of this invention.

Referring to first to FIG. 1, reference sign 10 denotes a machine base or frame of a highly-viscous-fluid applying system in the form of an adhesive applying system 12. On the machine base 10, there are mounted a highly-viscous-fluid applying apparatus in the form of an adhesive applying apparatus 14 and an object supporting and transferring device in the form of a printed-wiring-board supporting and transferring device 18 arranged to transfer, position and support a circuit substrate in the form of a printed-wiring board 16. The printed-wiring-board supporting and transferring device 18 (hereinafter referred to as "PWB transfer device 18") includes a printed-wiring board conveyor 20 disposed so as to extend in an X-axis direction (right and left direction as seen in FIG. 1), and a printed-wiring-board supporting device (not shown) and a printed-wiring-board clamping device (not shown), which are disposed within a length of the PWB conveyor 20. The printed-wiring board 16 is fed or transferred by the PWB conveyor 20 in the X-axis direction, stopped by a stopper device (not shown) at a predetermined coating position, supported by the printed-wiring-board supporting device, and clamped by the printed-wiring-board clamping device. The printed-wiring board 16 clamped at the predetermined coating position is coated with a highly viscous fluid in the form of an adhesive agent. In the present embodiment, the printed-wiring board 16 is fed in the X-axis direction while the board 16 maintains a horizontal attitude, that is, such that the major upper and lower surfaces of the board 16 are held parallel to an XY plane defined by the above-indicated X-axis direction and a Y-axis direction perpendicular to the X-axis direction.

Figure 2:
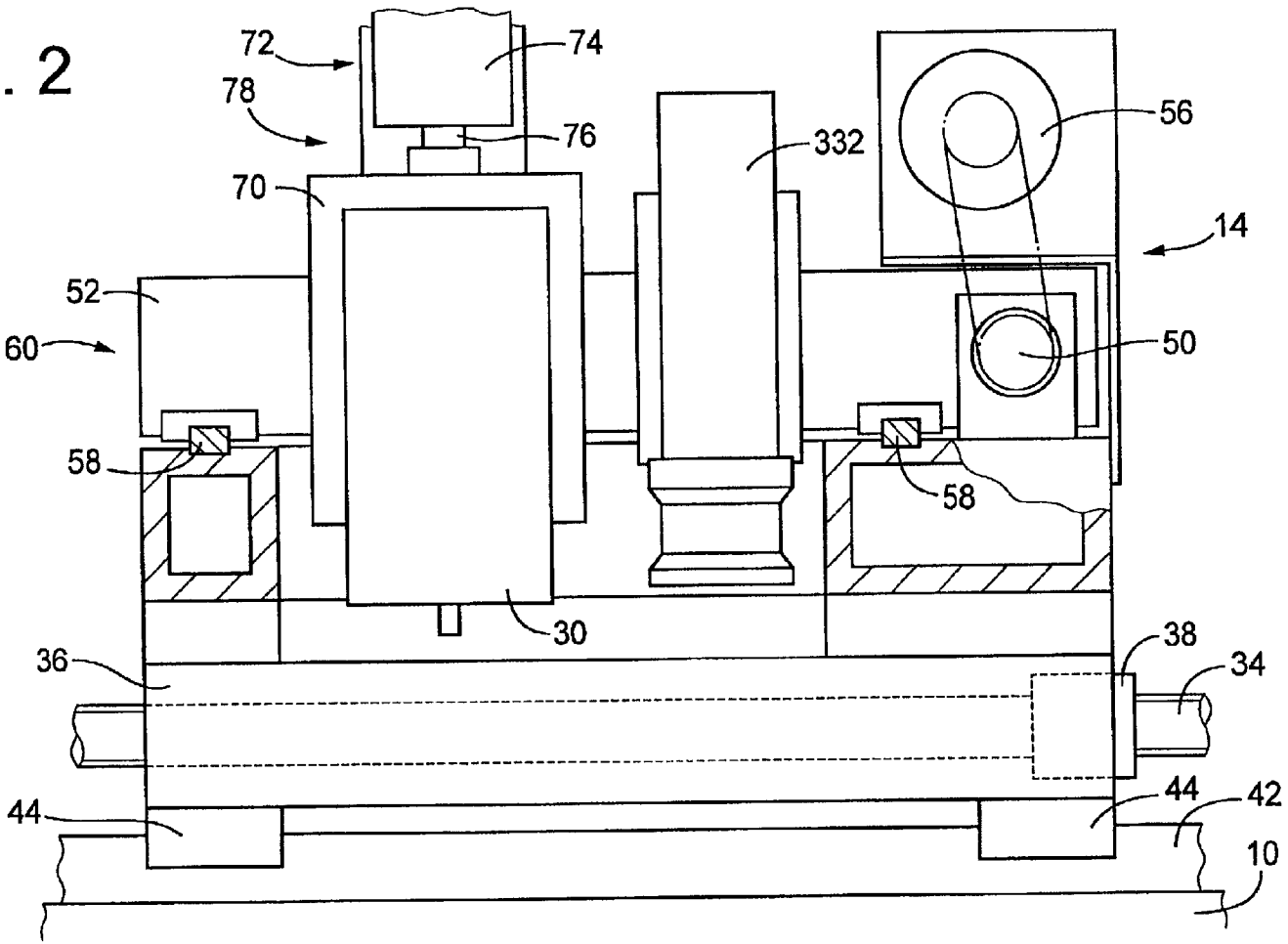
FIG. 2 is a front elevational view partly in cross section schematically showing the adhesive applying apparatus.

The adhesive applying apparatus 14 will be first described. The adhesive applying apparatus 14 includes a dispenser unit 30 which is movable in the XY plane, that is, along the mutually perpendicular X-axis and Y-axis directions. The upper surface of the printed-wiring board 16 is a working surface 32 parallel to the XY plane. The dispenser unit 30 is moved to a plurality of predetermined coating positions on the working surface 32, so that the dispenser unit 30 applies the adhesive agent to predetermined fluid-applying spots corresponding to the coating positions. For moving the dispenser unit 30 in the XY plane, two feedscrews 34 are disposed on the opposite sides of the PWB conveyor 20, so as to extend in the X-axis direction, and so as to be spaced apart from each other in the Y-axis direction, as shown in FIG. 1. The two feedscrews 34 are held in meshing engagement with respective two nuts 38 (shown in FIG. 2) fixed to an X-axis slide 36, and are rotated by respective X-axis drive motors 40 (shown in FIG. 1), in synchronization with each other, so that the X-axis slide 36 is moved in the X-axis direction. As shown in FIG. 2, the machine base 10 has two guiding members in the form of guide rails 42 formed under the respective two feedscrews 34, while the X-axis slide 36 has two guide blocks 44 which slidably engage the respective guide rails 42, so that the movement of the X-axis slide 36 is guided by the guide rails 42 and guide blocks 44, which cooperate with each other to constitute a guiding device.

On the X-axis slide 36, there is disposed a feedscrew 50 extending in the Y-axis direction, as shown in FIGS. 1 and 2. The feedscrew 50 is held in meshing engagement with a nut (not shown) fixed to a Y-axis slide 52, and is rotated by a Y-axis drive motor 56 (shown in FIG. 2), so that the Y-axis slide 52 is moved in the Y-axis direction while being guided by guiding members in the form of a pair of guide rails 58 serving as a guiding device. The nuts 38, feedscrews 34 and X-axis drive motors 40 constitute an X-axis drive device, while the nut 54, feedscrew 50 and Y-axis drive motor 56 constitute a Y-axis drive device. These X-axis and Y-axis drive devices cooperate with the X-axis and Y-axis slides 36, 52 to constitute an XY robot 60 which serves as a device for moving the highly-viscous-fluid applying apparatus in the form of the adhesive applying apparatus 14. In the present embodiment, the printed-wiring board 16 is supported by the printed-wiring-board supporting device of the PWB transferring device 18, such that the working surface 32 is parallel to the horizontal plane or XY plane, and the dispenser unit 30 is movable in the XY plane.

The dispenser unit 30 will then be described. The dispenser unit 30 is vertically movable on the Y-axis slide 52, toward and away from the printed-wiring board 16. To this end, the Y-axis slide 52 is provided with a pair of guiding members in the form of guide rails (not shown) extending in the vertical direction, and a Z-axis slide 70 which slidably engage the guide rails through guide blocks (not shown). The Z-axis slide 70, which carries the dispenser unit 30, is moved in the vertical direction by a Z-axis drive device 72. In the present embodiment, the Z-axis drive device 72 includes as a drive source a fluid-operator actuator in the form of an air cylinder 74 serving as a fluid-operated cylinder. The Z-axis drive device 72 further includes a piston rod 76 which is connected to the Z-axis slide 70 and is moved by the air cylinder 74. With a vertical movement of the piston rod 76, the Z-axis slide 70 is vertically moved to move the dispenser unit 30 in the vertical direction toward and away from the working surface of the printed-wiring board 16. In the present embodiment, the air cylinder 74 is provided with a restrictor mechanism for restricting an air flow into an air chamber thereof when its piston has been moved to a position close to the stroke end, so that the Z-axis slide 70 can be slowed down and stopped at its stroke end. The Z-axis slide 70 and the Z-axis drive device 73 cooperate to constitute an elevator device 78 serving as a relative-movement device operable to move the dispenser unit 30 and the object in the form of the printed-wiring board 16 relative to each other in the vertical direction perpendicular to the working surface 32. The elevator device 78 also serves as a nozzle elevator device operable to move a one-point coating delivery nozzle 90 (described below) of the dispenser unit 30 in the vertical direction. On the other hand, the XY robot 60 serves as a nozzle moving device operable to move the delivery nozzle 90 in the XY plane parallel to the working surface 32 of the printed-wiring board 16. In the present embodiment, the Z-axis slide 70 constitutes a body of the adhesive applying apparatus 14, while the XY robot 60 and the Z-axis drive device 72 cooperate to constitute a relative-movement device operable to move the Z-axis slide 70 and the printed-wiring board 16 relative to each other in the vertical direction perpendicular to the working surface 32. The elevator device 78 may use as its drive source an electric motor in the form of a servomotor for moving the dispenser unit 30 in the vertical direction.

Figure 3:
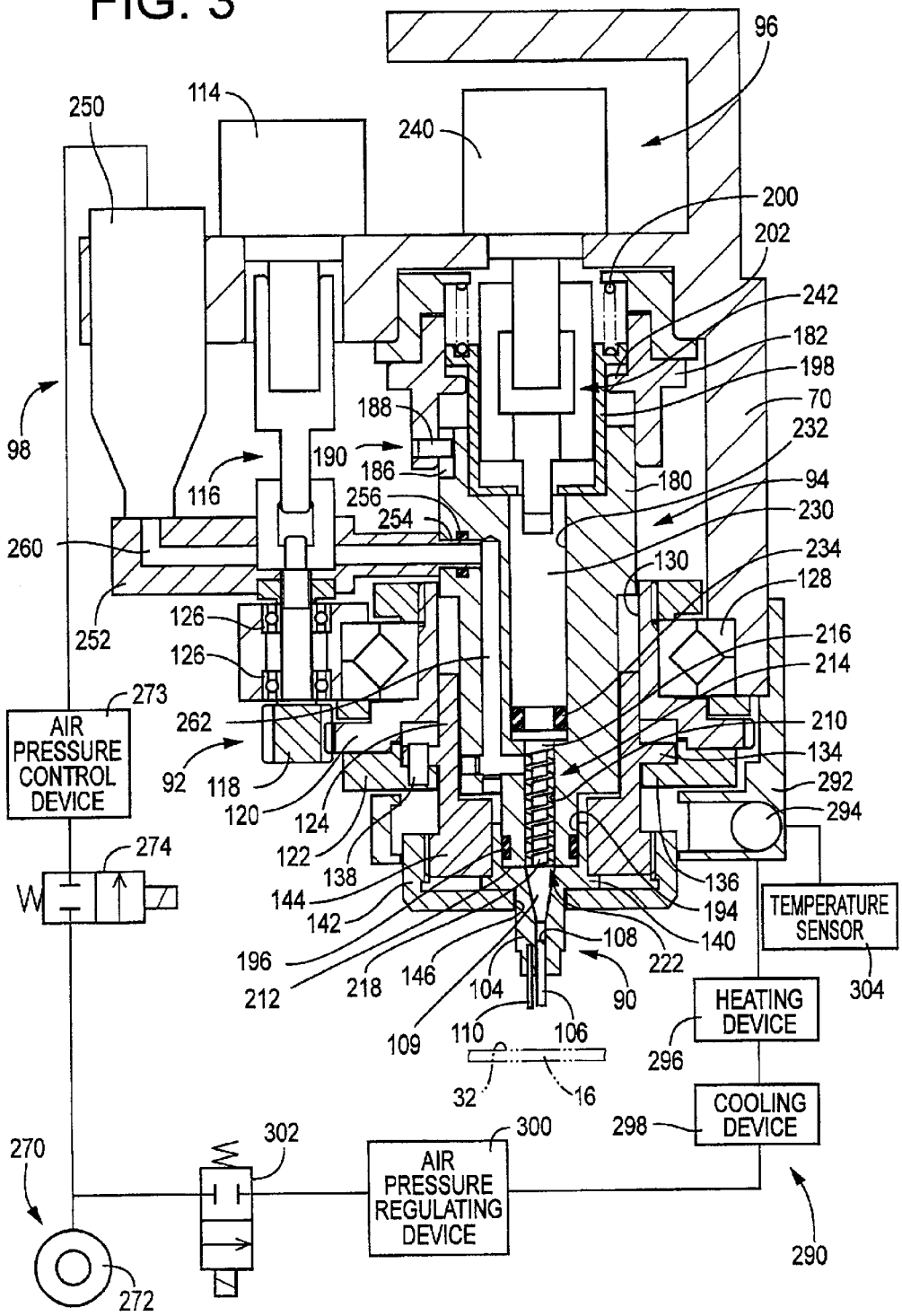
FIG. 3 is a front elevational view partly in cross section showing a dispenser unit of the adhesive applying apparatus.

As shown in FIG. 3, the dispenser unit 30 includes the above-indicated delivery nozzle 90, a nozzle rotating device 92, a screw pump 94, a screw rotating device 96 and a highly-viscous-fluid supply device in the form of an adhesive supply device 98.

The delivery nozzle 90 of the dispenser unit 30 will be described first. The delivery nozzle 90 includes a nozzle body 104 and one delivery tube 106. The nozzle body 104 has a circular shape in transverse cross section, and a passage 108 axially extending therethrough coaxially with its outer circumferential surface. The delivery tube 106 is fitted in the lower end portion of the passage 108 such that the delivery tube 106 extends downwards from the nozzle body 104 coaxially with the nozzle body 104. The upper end portion of the passage 108 is formed as a tapered passage 109 whose diameter linearly increases in the upward direction away from the delivery tube 106.

The nozzle body 104 further carries a pin 110 which extends from its lower end face such that the pin 110 is parallel to the delivery tube 106 and is offset from the delivery tube 106 in the radial direction. The pin 110, which serves as a gap-defining portion, is formed integrally with the delivery nozzle 90, and disposed in the vicinity of the delivery tube 106 in the radial direction, such that the pin 110 is not movable relative to the nozzle body in the axial and radial directions, and such that the lower end of the pin 110 is located a suitable distance below the lower end of the delivery nozzle 90, that is, below the lower end face of the delivery tube 106.

The delivery nozzle 90 is rotated by the nozzle rotating device 92, about its axis, namely, about the axis of the nozzle body 104. In the present embodiment, the nozzle rotating device 92 includes, as a drive source an electric motor in the form of a nozzle rotating motor 114, which is a servomotor. A rotary motion of the motor 114 is transmitted to a sleeve 124 through a joint 116, a drive gear 118, a driven gear 120 and a ring member 122. The delivery nozzle 90 is removably attached to the sleeve 124, so that the delivery nozzle 90 is rotated when the sleeve 124 is rotated. When the delivery nozzle 90 is rotated, the pin 110 is rotated about the axis of rotation of the delivery nozzle 90, so that the position of the pin 110 in the circumferential or rotating direction of the delivery nozzle 90 is changed.

The drive gear 118 is supported by the Z-axis slide 70 through bearings 126, such that the drive gear 118 is rotatable about its vertically extending axis, while the driven gear 120 is supported by the Z-axis slide 70 through a bearing 128, such that the driven gear 120 is rotatable about its vertically extending axis. The driven gear 120 is held in meshing engagement with the drive gear 118, and the ring member 122 is coaxially fixed to the driven gear 120. The sleeve 124 has a cylindrical shape, and extends through the ring member 122. The sleeve 124 is fitted in a through-hole 130 formed through the driven gear 120 in the axial direction such that the sleeve 124 is axially movable relative to the driven gear 120. The sleeve 124 has a radially outwardly extending flange portion 134, while the ring member 122 has a radially inwardly extending flange portion 136. The sleeve 124 is supported at its flange portion 134 by the underlying flange portion 136 of the ring member 122, so that the sleeve 124 is prevented from moving downwards. The flange portion 134 is held in engagement with a pin 138 which is fixed to the flange 136 so as to extend in the axial direction of the ring member 122. This arrangement prevent a rotary motion of the sleeve 124 relative to the ring member 122, but permits an axial motion of the sleeve 124 relative to the ring member 122. Thus, the pin 138 serves as a relative-rotation preventing device for preventing relative rotation of the sleeve 124 and the ring member 122, and a rotary-motion transmitting device for transmitting the rotary motion between the sleeve 124 and the ring member 122.

Within the sleeve 124, there is coaxially fitted the upper end portion of the nozzle body 104 of the delivery nozzle 90. The nozzle body 104 has a radially outwardly extending flange portion 140 at its axially intermediate portion. The uppermost position of the nozzle body 104 is determined by abutting contact of the flange portion 140 with the lower end face of the sleeve 124. This abutting contact is maintained by a nut 142 screwed on an externally threaded lower end portion 144 of the sleeve 124, which protrudes downwards from the ring member 122. Thus, the delivery nozzle 90 is removably attached to the sleeve 124, and is attached to the Z-axis slide 70 through the sleeve 124, etc. In the present embodiment, the nut 142 is a cup-like member consisting of an internally threaded cylindrical portion meshing the externally threaded portion 144, and a bottom portion having a central opening 146. The nozzle body 104 extends through the central opening 146 of the nut 142, and is attached to the sleeve 124 such that the flange portion 140 of the nozzle body 104 is sandwiched by and between the bottom portion of the nut 142 and the sleeve 124. According to this arrangement, a rotary motion of the sleeve 124 causes the delivery nozzle 90 to be rotated about the vertically extending axis of the nozzle body 104. The sleeve 124 is axially movably fitted in the driven gear 120, so that the delivery nozzle 90 and the pin 110 are movable relative to the Z-axis slide 70 in the axial direction of the delivery nozzle 90.

Figure 4:
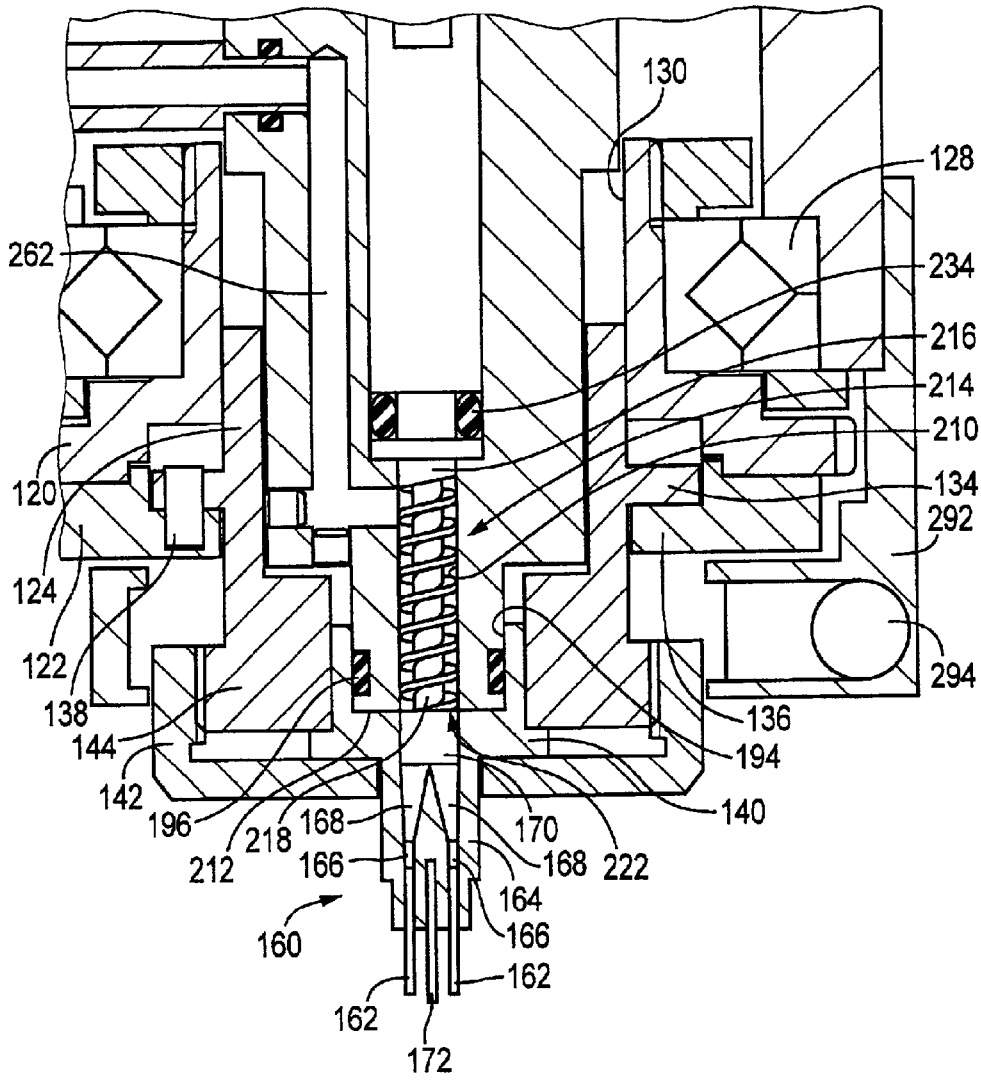
FIG. 4 is a front elevational view showing a delivery nozzle according to a second embodiment of this invention, which has two delivery tubes, rather than a single delivery tube of a nozzle device shown in FIG. 3, and which is held by a nozzle rotating device.

As described above, the delivery nozzle 90 is removably attached to the nozzle rotating device 92, and thus serves as a nozzle holding device for holding the delivery nozzle 90. Although FIG. 3 shows the delivery nozzle 90 attached to the nozzle rotating device 92, two or more different kinds of delivery nozzle may be selectively attached to the nozzle rotating device, for coating the printed-wiring board 16 with the adhesive agent. For instance, a second embodiment of this invention uses a multiple-point delivery nozzle in the form of a two-point coating delivery nozzle 160 having two delivery tubes 162, which may be attached to the nozzle rotating device 92, as shown in FIG. 4, in place of the one-point coating delivery nozzle 90. The two delivery tubes 162 are disposed on the delivery nozzle 160, at respective two radial positions which lie on a circle having a center on the axis of a nozzle body 164 and which are opposed to each other in a diametric direction of the nozzle body 164. The nozzle body 164 has two passages 166 formed therethrough so as to extend in the axial direction, and the two delivery tubes 162 are fixedly fixed in the lower end portions of the respective two passages 166. The two delivery tubes 162 are identical in construction with each other, extending in parallel with each other, for delivering the same amount of adhesive agent onto the printed-wiring board 16. The upper end portions of the two passages 166 are formed as tapered passages 168 whose diameter linearly increases in the upward direction away from the delivery tube 162 and which communicate with a common passage 170 which is formed coaxially through the nozzle body 164 and which has a relatively large diameter. The nozzle body 164 further carries a pin 172 which coaxially extends downwards from its lower end face such that the lower end of the pin 172 is located a suitable distance below the lower end of the two delivery tubes 162. Like the pin 110, the pin 162 serves as a gap-defining portion.

Then, the screw pump 94 and the screw rotating device 96 will be described. The screw pump 94 has a pump housing 180 which is a stepped cylindrical member having a circular shape in transverse cross section. The pump housing 180 is supported by the Z-axis slide 70 such that the pump housing 180 is axially or vertically movable relative to the Z-axis slide 70 and is not rotatable relative to the Z-axis slide 70. Described more specifically, a guide member 182 is fixed to the Z-axis slide 70, and the pump housing 180 is fitted at its upper end portion in the guide member 182 such that the pump housing 180 is axially movable and is not ratable relative to the guide member 182. The guide member 182 is fixed to a portion of the Z-axis slide 70 which is located above the driven gear 120. The guide member 182 may be considered as a part of the Z-axis slide 70. The upper end portion of the pump housing 180 has a groove 186 formed in its outer circumferential surface such that the groove 186 extends in the axial direction of the pump housing 180 and is open in the upper end face of the pump housing 180. The guide member 182 has a pin 188 fixed thereto, for engagement with the groove 186 such that the pin 188 is movable relative to the groove 186 in the axial direction of the pump housing 180. The groove 186 and the pin 188 prevent a rotary motion of the pump housing 180 relative to the Z-axis slide 70. Namely, a protruding portion in the form of the pin 188 and a recessed portion in the form of the groove 186 cooperate to constitute a relative-rotating preventing device 190 for preventing relative rotation of the pump housing 180 and the X-axis slide 70.

The lower end portion of the pump housing 180 extends through the through-hole 130 formed through the driven gear 120, and further through the sleeve 124, and is fitted in a blind fitting hole 194 formed in the nozzle body 104 of the delivery nozzle 90, such that the lower end portion of the pump housing 180 is axially movable and rotatable relative to the nozzle body 104 of the delivery nozzle 90. The delivery nozzle 90 coaxially extends from the lower end portion of the screw pump 94. Fluid tightness between the lower end portion of the pump housing 180 and the blind fitting hole 194 of the nozzle body 104 is maintained by an O-ring 196 interposed therebetween.

In the upper end portion of the pump housing 180, there is fitted a cylindrical spring sheet 198. Between this spring sheet 198 and the guide member 182, there is interposed a biasing device in the form of a compression coil spring 200 serving as an elastic member, which biases the pump housing 190 in a direction toward the delivery nozzle 90, so that the pump housing 190 is held in abutting contact at its lower end portion with the bottom surface of the fitting hole 194 of the delivery nozzle 90. In this arrangement, the delivery nozzle 90 is biased by the spring 200 through the pump housing 180, in a direction from its proximal or upper end toward the distal or lower end. The lowermost position of the delivery nozzle 90 biased by the spring 200 is determined by the abutting contact of the flange portion 134 of the sleeve 124 with the flange portion 136 of the ring member 122. The flange portion 136 functions as a stop while the flange portion 134 functions as an engaging portion for abutting contact with the stop to prevent an axial movement of the delivery nozzle 90. In this arrangement, the pump housing 180, spring sheet 198 and delivery nozzle 90 are moved as a unit in the axial direction of the delivery nozzle 90. It will be understood that the ring member 122 including the flange portion 136 and supporting the delivery nozzle 90 functions as a support member for supporting the delivery nozzle 90 so as to prevent a downward movement of the delivery nozzle 90. To prevent a downward movement of the spring sheet 198 when the pump housing 180 is removed from the Z-axis slide 70, the guide member 182 is provided with a radially inwardly extending flange portion 202 for engagement with the upper end portion of the spring sheet 198. The guide member 182 functions to guide the axial movement of the pump housing 180, and to prevent the removal of the spring sheet 198. When the pump housing 180 is installed on the Z-axis slide 70 and the delivery nozzle 90 is positioned in place with its lowermost position determined by the flange portion 136 of the ring member 122, the upper end portion of the spring sheet 198 is spaced apart from the flange portion 202 of the guide member 182, so that the biasing force of the spring 200 acts on the pump housing 180 and the delivery nozzle 90.

The pump housing 180 has a coaxially formed screw chamber 210 having a circular shape in transverse cross section. The screw chamber 210 is open in a lower axial end face 212 of the pump housing 180. In this screw chamber 210, there is rotatably accommodated a screw 214, which consists of a relatively short cylindrical proximal or base portion 216 and a helical portion 218 which extends from the base portion 216 coaxially with the base portion 216. The helical portion 218 has a helical thread. The screw 214 is substantially fluid-tightly and rotatably fitted in the screw chamber 210 with a small clearance left between the inner circumferential surface of the screw chamber 210 and the outer circumferential surface of the base portion 216 and the crest of the helical thread of the helical portion 218. The clearance is small enough to permit rotation of the screw 214 within the screw chamber 210.

The lower opening of the screw chamber 210 in the lower end face 212 of the pump housing 180 serves as a delivery port 222, which communicates with the passage 108 formed through the nozzle body 104 of the delivery nozzle 90. As described above, the lower end portion of the pump housing 180 is fitted in the fitting hole 194 of the delivery nozzle 90, and is held in abutting contact with the bottom surface of the fitting hole 194 under the biasing action of the spring 200, so that the passage 108 is held in communication with the delivery port 222. The largest diameter of the tapered passage 109 formed as the upper portion of the passage 108 remote from the delivery tube 106 is made equal to that of the delivery port 222. When the delivery nozzle 90 is held by the nozzle rotating device 92, the tapered passage 108 is brought into communication with the screw chamber 210 through the delivery port 222. Similarly, the diameter of the common passage 170 of the delivery nozzle 160 shown in FIG. 4 is made equal to that of the delivery portion 222, and the common passage 170 is brought into communication with the screw chamber 210 through the delivery port 222 when the delivery nozzle 160 is held by the nozzle rotating device 92.

A rotary shaft 230 extends from the upper end of the proximal or base portion 216 of the screw 214 in the upward direction such that the rotary shaft 230 is coaxial with the screw 214. The rotary shaft 230 has a larger diameter than the screw 214, and is rotatably fitted in a shaft hole 232 formed in the pump housing 180, coaxially with the screw chamber 210. An O-ring 234 is mounted on the lower end portion of the rotary shaft 230 on the side of the screw 214, to maintain fluid tightness between the pump housing 180 and the rotary shaft 230, while permitting a rotary motion of the rotary shaft 230. The O-ring 234 serves as a sealing device for the screw chamber 210.

The rotary shaft is rotated by a screw rotating device 96, which includes a drive source in the form of a screw drive motor 240 disposed on the Z-axis slide 70 such that its output shaft extends in the axial direction of the rotary shaft 230. In the present embodiment, the screw drive motor 240 is a rotary electric motor in the form of a servomotor. A rotary motion of the screw drive motor 240 is transmitted to the rotary shaft 230 through a joint 242, and the screw 214 is rotated with a rotary motion of the rotary shaft 230 about its vertically extending axis.

The screw pump 9 is supplied with the adhesive agent by the adhesive supply device 98. The adhesive supply device 98 has a container 250 for accommodating a mass of the adhesive agent. The container 250 is mounted on a portion of the Z-axis slide 70, which is located above the pump chamber 210. The container 250 is disposed such that it is vertically movable relative to the Z-axis slide 70, and extends in the vertical direction. The container 250 is connected to the pump housing 180 through a connecting member 252, which extends generally in the horizontal direction. The connecting member 252 has a cylindrical connecting end portion 254 remote from the container 250, and is connected at this connecting end portion 254 to a portion of the pump housing 180 which is located above the screw chamber 210. The connecting member 252 is disposed perpendicularly to the axis of the screw 214. A sealing device in the form of an O-ring 256 is interposed between the connecting end portion 254 of the connecting member 252 and the pump housing 180, to maintain fluid tightness between the connecting member 252 and the pump housing 180.

The connecting member 252 has a supply passage 260 formed therethrough. The supply passage 260 consists of a vertically extending end portion communicating with the bottom of the container 250, and a horizontally extending portion which is open, at its end remote from the vertically extending end portion, at the open end of the connecting end portion 254 which communicates with a supply passage 262 formed through the pump housing 180. The supply passage 262 extends in the axial direction of the pump housing 180, that is, in the vertical direction, and is held in communication at its upper end with the supply passage 260 through the connecting end portion 254. The lower end portion of the supply passage 262 is open in the inner circumferential surface of the upper end portion of the screw chamber 210, and is held in communication with the delivery nozzle 90 through the screw chamber 210. The screw pump 94 has a first end on the side of the delivery nozzle 90, and a second end on the side of the connection between the screw chamber 210 and the supply passage 262. The supply passage 260 is communicated with the second end of the screw pump 94 through the supply passage 262. The two supply passages 260, 262 cooperate to form a supply passage connecting the screw pump 94 and a highly-viscous-fluid supply device of pressurized type in the form of the adhesive supply device 98.

The container 250 has an upper air chamber which is charged with pressurized or compressed air supplied from a compressed-air supply device 270. Thus, the adhesive supply device 98 is of pressurized type. The compressed-air supply device 270 has a compressed-air supply source 272, which is connected to the container 250 through an air passage provided with a series connection of an air pressure control device 273 and a solenoid-operated control valve in the form of a solenoid-operated shut-off valve 274. The air pressure control device 273 is arranged to regulate the pressure of the compressed air supplied from the compressed-air supply source 272, to a level suitable for pressurizing the adhesive agent accommodated within the container 250, so that the compressed air having the suitably regulated pressure is introduced into the air chamber of the container 250.

The solenoid-operated shut-off valve 274 is a normally closed valve. The compressed air is fed from the compressed-air supply source 272 into the air chamber in the container 250, to pressurize the adhesive agent, when the shut-off valve 274 is switched from its closed state to its open state. As a result, the supply passages 260, 262 and the screw chamber 210 are filled or charged with the adhesive agent. Thus, the screw pump 94 can be supplied with the adhesive agent, without air left in the supply passages 260, 262, namely, with the supply passages 260, 260 being filled with the adhesive agent, even where the adhesive agent has a relatively high degree of viscosity. It is noted that the adhesive supply device 98 and the nozzle rotating device 92 are disposed at different circumferential positions of the delivery nozzle 90, and do not interfere with each other.

In the present embodiment, the temperatures of the masses of the adhesive agent within the screw chamber 210 and the delivery nozzle 90 are controlled by a temperature control device 290, to a value suitable for the dispenser unit 20 to apply the adhesive agent to the printed-wiring board 16. Since the manner of controlling the temperature of the adhesive agent is well known as disclosed in JP-A-10-99756, the temperature control of the adhesive agent will be briefly described.

The Z-axis slide 70 carries a gas supply body in the form of an air supply body 292 fixed thereto. The air supply body 292 is disposed radially outwardly of the sleeve 124 and the nut 142, which surround the portion of the pump housing 180 in which is formed the screw chamber 210 accommodating the screw 215. The air supply body 292 has an annular gas passage in the form of an air passage 294 which is open to the sleeve 124 and through which a gas in the form of air is circulated in direct contact with the sleeve 124, for controlling the temperature of the portion of the pump housing 180 in which the screw 214 is disposed.

The air passage 294 is connected to the compressed-air supply source 272 through a passage provided with a series connection of a heating device 296, a cooling device 298, air pressure regulating device 300 and a solenoid-operated shut-off valve 302. The air pressure regulating device 300 is arranged to regulate the pressure of the compressed air received from the compressed-air supply source 272, so that the compressed air having the thus regulated pressure is fed to the heating and cooling devices 296, 298. The compressed air the temperature of which has been suitably controlled by the heating and cooling devices 296, 298 is introduced into the air passage 294, and is blown onto the sleeve 124 and nut 142. The portion of the pump housing 180 in which the screw 214 is disposed is fitted in the nozzle body 104 of the delivery nozzle 90, and the nozzle body 104 is fitted in and sandwiched between the sleeve 124 and the nut 142. In this arrangement, thermal conduction between the compressed air flowing through the air passage 294 and the portion of the pump housing 180 in which the screw is disposed, is effected via the sleeve 124 and nut 142, so that the masses of the adhesive agent within the screw chamber 210 and the delivery nozzle 90 are heated and cooled to a predetermined optimum temperature suitable for the delivery nozzle 90 to apply the adhesive agent to the printed-wiring board 16.

The air passage 294 is provided with a temperature sensor 304 for detecting the temperature of the air within the air passage 294. The temperature of the air within the air passage 294 is held at a level for maintaining the adhesive agent within the screw chamber 210 and delivery nozzle 90 at the predetermined optimum level. In the present embodiment, the temperature of the air within the air passage 294 is controlled to be equal to the predetermined optimum level. When the temperature of the air within the air passage 294 is lower than the optimum level by more than a predetermined amount, the heating device 296 is operated to heat the compressed air before the compressed air is fed into the air passage 294. In this case, the cooling device 298 is held in the non-operated state in which the compressed air is permitted to flow therethrough to the heating device 196. When the temperature of the air within the air passage 294 is higher than the optimum level by more than a predetermined amount, the cooling device 298 is operated to cool the compressed air before the compressed air is fed into the heating device 296. In this case, the temperature of the compressed air is cooled by the cooling device 298 by more than the predetermined amount, and is then heated by the heating device 196 to the predetermined optimum level. The temperature of the air within the air passage 294 may be controlled to a level which is different from, that is, lower or higher than the predetermined optimum temperature level of the adhesive agent within the screw chamber 210 and delivery nozzle 90.

As shown in FIG. 2, the Y-axis slide 36 carries an image-taking device in the form of a CCD camera 332, which is arranged to take a two-dimensional image of an object at one time. The CCD camera 332 is disposed on the Y-axis slide 36 such that the optical axis of the CCD camera 332 extends in the vertical direction and such that the CCD camera 332 faces downwards. The CCD camera 332 is moved by the XY robot 60 in the XY plane, which is parallel to the working surface 32 of the printed-wiring board 16. When an image of the object is taken by the CCD camera 332, the object and its vicinity are illuminated by an illuminating device disposed near the CCD camera 332. The XY robot 60 also serves as a device for moving the image-taking device in the form of the CCD camera 332.

Figure 5:
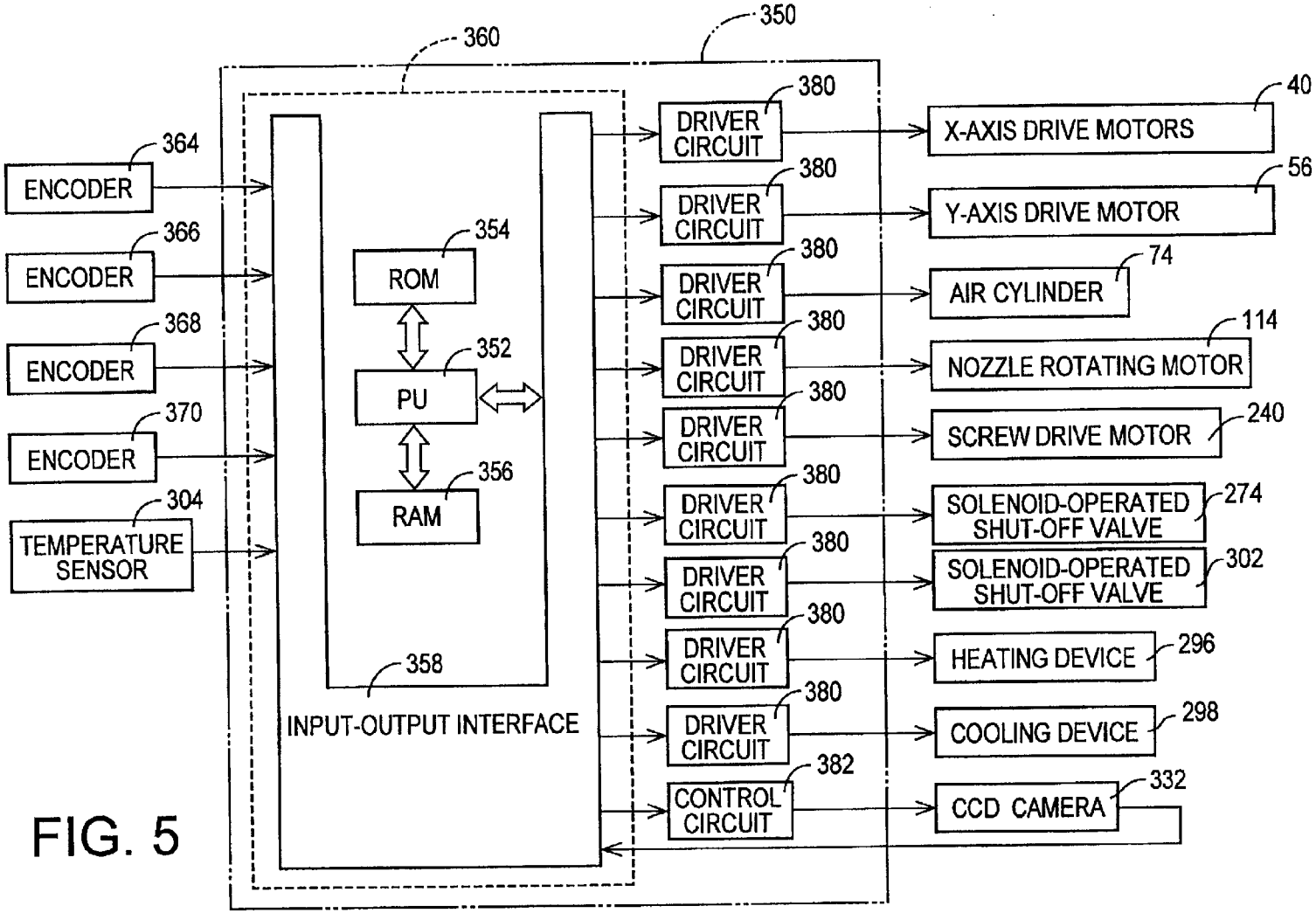
FIG. 5 is a block diagram a portion of a control device of the adhesive applying system, which portion relates to the present invention.

The present adhesive applying system 12 includes a control device 350 shown in the block diagram of FIG. 5. The control device 350 is principally constituted by a computer 360 incorporating a processing unit (PU) 352, a read-only memory (ROM) 354, a random-access memory (RAM) 356, and an input-output interface 358. To the input-output interface 358, there are connected encoders 364, 366, 368 and 370 and the CCD camera 332. The encoders 364, 366, 368, 370 are provided to detect the operating amounts or angles of the X-axis drive motor 40, Y-axis drive motor 56, nozzle rotating motor 114 and screw drive motor 240, respectively. These encoders 364–370 function as detecting devices for detecting the operating amounts of the motors 40, 52, 114, 240.

To the input-output interface 358, there are also connected the various actuators such as the X-axis drive motor 40 through respective driver circuits 380, and the CCD camera 332 through a control circuit 382, as shown in FIG. 5. The drive motors 40, 56, 114, 240 are servomotors the operating amounts or angles of which can be controlled with high accuracy. However, these drive motors may be stepping motors. The RAM 356 includes various memories as a DELIVERY-AMOUNT DETECTION MODE memory and a control program memory, as well as a working memory, as shown in FIG. 18. The control program memory stores various control programs such as a program for executing a main routine illustrated in the flow chart of FIG. 6.

There will be described an operation of the adhesive applying system 12 to coat the printed-wiring board 16 with the adhesive agent. Initially, the printed-wiring board 16 is loaded onto the adhesive applying system 12 by the PWB conveyor 20. The printed-wiring board 16 is stopped at the predetermined coating position, supported by the printed-wiring-board supporting device and clamped by the printed-wiring-board clamping device. Then, the dispenser unit 20 is moved by the XY robot 60 to various coating positions on the printed-wiring board 16, at which the adhesive agent is applied from the delivery nozzle 90 or 160 to the corresponding adhesive-applying spots on the printed-wiring board 16.

The manner of applying the adhesive agent to the printed-wiring board 16 will be described briefly. In the present embodiment, the printed-wiring boards 16 of the same type or kind are successively coated with the adhesive agent, using a selected one of the delivery nozzles 90 and 170. The one-point delivery nozzle 90 is used to perform a one-point coating operation in which the adhesive agent is applied to one spot at one time with the coating head 30 located at the corresponding coating position. The two-point coating delivery nozzle 160 is used to perform a two-point coating operation in which the adhesive agent is applied to two spots at one time with the dispenser unit 30 located at the corresponding coating position. If necessary, a delivery head for performing a multiple-point coating operation may be used to apply the adhesive agent to three or more spots at one time with the dispenser unit 30 located at the corresponding coating position. Further, the coating operation may be selectively performed in one of three coating modes, that is; a large-amount coating mode in which a relatively large amount of the adhesive agent is applied to each spot; a small-amount coating mode in which a relatively small amount of the adhesive agent is applied to each spot; and a medium-amount coating mode in which the amount of the adhesive agent is intermediate between the large and small amounts. In the present embodiment, the coating operation in the large-amount coating mode is performed first at a plurality of spots, and the coating operation in the medium-amount coating mode is performed next at a plurality of spots. Finally, the coating operation in the small-amount coating mode is performed at a plurality of spots. The amount of the adhesive agent to be delivered from the delivery nozzle 90, 160 can be changed by changing the operating angle of the screw drive motor 240 to thereby change the rotating angle of the screw 214. The amount of the adhesive agent to be delivered increases with an increase of the rotating angle of the screw 214. The operating angle of the screw drive motor 240 is determined depending upon the selected coating mode. Angle data representative of the predetermined operating angles of the screw drive motor 240 corresponding to the large-, medium- and small-amount coating modes are stored in respective LARGE, MEDIUM and SMALL DELIVERY-AMOUNT memories of the RAM 356. These DELIVERY-AMOUNT memories also store delivery-amount data representative of the desired delivery amounts of the adhesive agent corresponding to the respective large-, medium- and small-amount coating modes. The angle data and delivery-amount data are stored in the DELIVERY-AMOUNT memories, for each of the one-point and two-point coating operations.

The adhesive applying system 12 according to the present invention is further arranged to detect the actual amount of the adhesive agent applied to the printed-wiring board 16, and compare the detected actual amount with the desired delivery amount (in the selected coating mode) stored in the RAM 356. If the detected amount is larger or smaller than the desired amount, the rotating angle of the screw 214 is adjusted to change the actual amount to the desired amount. To detect the amount of the adhesive agent applied, a mass of the adhesive agent (hereinafter referred to as "adhesive mass") delivered to each of selected adhesive-applying spots on the working surface 32 of the printed-wiring board 16 is imaged by the CCD camera 332 in the vertical direction perpendicular to the horizontal working surface 32, and image data representative of an image of the adhesive mass are processed to calculate a surface area defined by the periphery of the adhesive mass, namely, a surface area of an outer profile of the adhesive mass within the imaging area of the CCD camera 332 in the XY plane. The amount of the adhesive mass can be obtained on the basis of the calculated surface area. The image of the adhesive mass is taken by the CCD camera 332 while the lower end of the pin 110 or 172 is held in contact with the working surface 32 of the board 16, that is, while there is a predetermined amount of gap between the lower end of the delivery tube 106 or delivery tubes 162 and the working surface 32. Since the temperature of the adhesive agent is held at a level equal or close to the optimum level, the adhesive mass applied to each adhesive-applying spot has a considerably high degree of consistency in its three-dimensional shape or geometry on the working surface 32 of the printed-wiring board 16. The image of the adhesive mass delivered to the adhesive-applying spot in question is taken by the CCD camera 332 a predetermined constant short time after the moment of delivery of the adhesive mass from the delivery nozzle 90, 160 and before the adhesive mass is delivered to the next adhesive-applying spot. Accordingly, there exists a close correlation between the surface area of the outer profile of the adhesive mass in the XY plane and the volume or amount of the adhesive mass, so that the amount of the adhesive mass can be estimated with high accuracy on the basis of the calculated surface area and according to the known correlation. In the present embodiment, the desired delivery amounts of the adhesive agent corresponding to the respective large-, medium- and small-amount coating modes are represented by the respective surface areas of the outer profile of the adhesive mass. An average of the calculated amounts of the adhesive mass delivered to the predetermined two or more adhesive-applying spots on the working surface 32 is compared with the desired delivery mount.

The detection of the delivery amount of the adhesive mass from the delivery nozzle 90, 160 is effected for the first one of the printed-wiring boards 16 of the same type, and after the coating operation has been performed on a predetermined number (N) of the boards 16 of the same type. For the first board 16, the delivery amount of the adhesive mass is detected at the predetermined number of adhesive-applying spots, for each of the large-, medium- and small-amount coating modes. On the basis of the detected delivery amounts in the different coating modes, the rotating angle of the screw 214 is automatically changed in the coating operations on the second and subsequent boards 16, so as to establish the desired delivery amounts in the respective large-, medium- and small-amount coating modes.

In the second and subsequent detections of the delivery amount of the adhesive mass, the delivery amount is detected in one of the three coating modes, at the predetermined number of adhesive-applying spots. The coating mode in which the second and subsequent detections are effected is changed in the order of the large-, medium- and small-amount coating modes, and the adhesive-applying spots in the same coating mod are changed as the board 16 on which the delivery amount is detected is changed. This arrangement assures accurate detection of the delivery amounts of the adhesive mass in each of the different coating modes and at each of the different adhesive-applying spots on the working surface 32.

Figure 6:
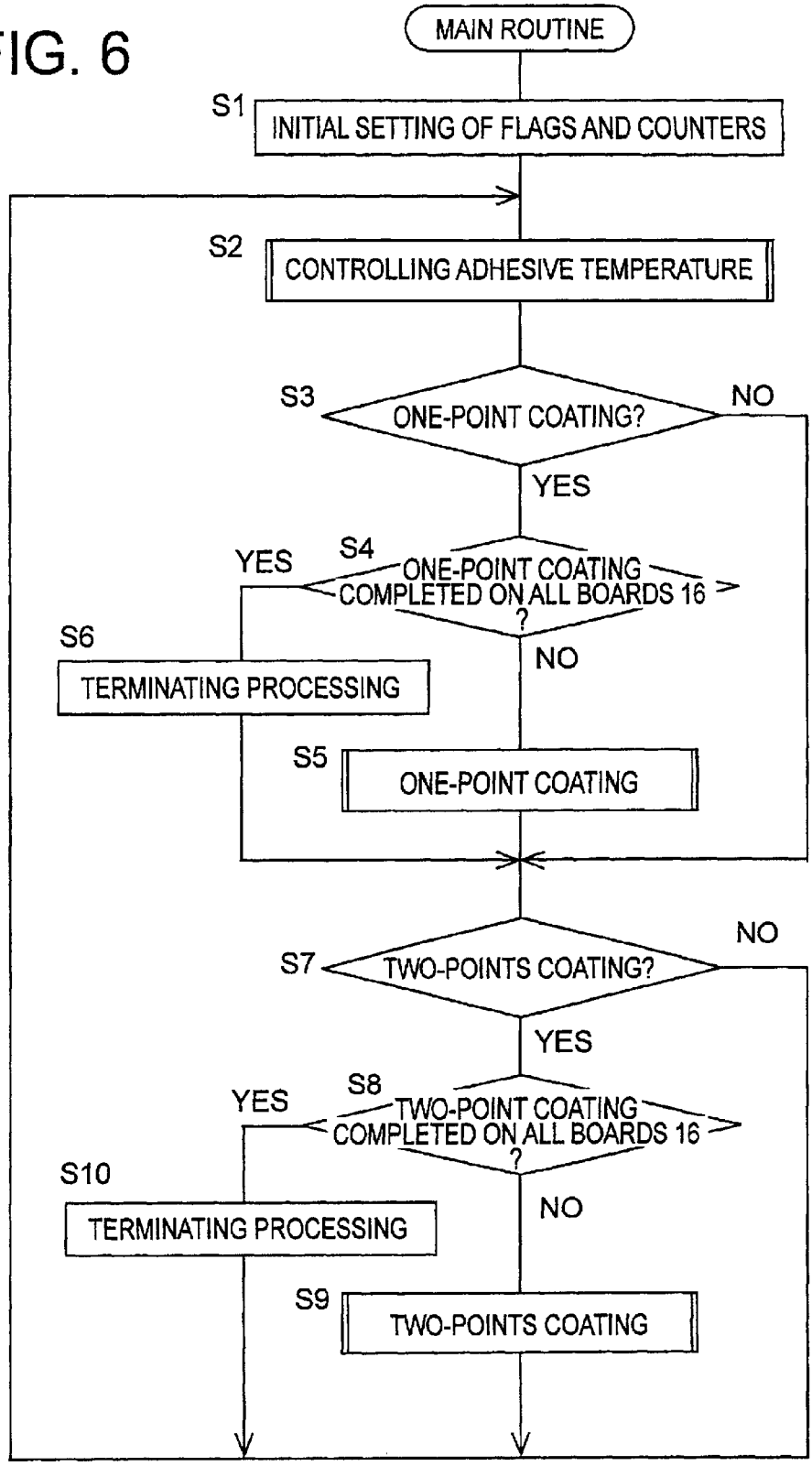
FIG. 6 is a flow chart illustrating a main routine executed according to a control program stored in a RAM of a computer of the control device of FIG. 5.

The coating operation will be described in detail by reference to the flow charts of FIGS. 6–17. The main routine of FIG. 6 is initiated with step S1 in which various flags and counters are initially reset to OFF states. Then, the control flow goes step S2 to control the temperature of the adhesive agent. Namely, the solenoid-operated shut-off valve 302 is switched to its open state, to feed the compressed air to the air passage 294, for blowing the compressed air onto the sleeve 124 and the nut 142. On the basis of the temperature of the air in the air passage 294 detected by the temperature sensor 304, the heating device 296 or cooling device 298 is operated to control the temperature of the air to the predetermined optimum level, for controlling the temperature of the adhesive agent to the optimum level for thereby maintaining the viscosity of the adhesive agent at a value suitable for delivery onto the working surface 32 of the board 16.

Then, step S3 is implemented to determine whether the one-point coating operation is to be performed. In the present embodiment, a selected one of the delivery nozzles 90, 160 is manually mounted on and removed from the nozzle rotating device 92, by the operator of the adhesive applying system 12. At this time, the operator enters data indicative of the one-point coating operation or the two-point coating operation, into the control device 350, and the entered data are stored in a COATING POINT-NUMBER memory of the RAM 356. The determination in step S3 is effected on the basis of the stored data indicative of the one-point or two-point coating operation.

Where the delivery nozzle 90 is mounted on the nozzle rotating device 92, to perform the on-point coating operation, an affirmative decision (YES) is obtained in step S3, and the control flow goes to step S4 to determine whether the one-point coating operation is completed on the last board 16 of the same type, that is, whether the one-point coating operation has been performed on all of the predetermined number of the boards 16 of the same type. The number of the boards 16 on which the one-point coating operation has been performed is updated or counted according to a coating control routine, and the determination in step S4 is effected on the basis of the counted number. If a negative decision (NO) is obtained in step S4, the control flow goes to step S5 in which the one-point coating operation is performed on the present board 16. If the one-point coating operation has been performed on all of the predetermined number of the boards 16 of the same type, an affirmative decision (YES) is obtained in step S4, and the control flow goes to step S6 to reset the various flags and counters and effect other processing to terminate the main routine.

Where the two-point coating operation is to be performed, a negative decision (NO) is obtained in step S3 while an affirmative decision (YES) is obtained in step S7, and the control flow goes to step S9 to determine whether the two-point coating has been performed on all of the predetermined number of the boards 16 of the same type. A negative decision (NO) is initially obtained in step S7, and the control flow goes to step S9 to perform the two-point coating operation on the present board 16. If the two-point operation has been performed on all of the predetermined number of the boards 16, an affirmative decision (YES) is obtained in step S8, and the control flow goes to step S10 to effect the processing to terminate the main routine. It is noted that only a part of the main routine which relates to the present invention is illustrated in the flow chart of FIG. 6.

Referring to the flow chart of FIG. 7, there will be described a one-point coating routine formulated to perform the one-point coating operation on the printed-wiring board 16 with the one-point coating delivery nozzle 90. Initially, step S11 is implemented to prepare command data for effecting the detection of the delivery amounts of the adhesive mass to be delivered from the delivery nozzle 90. The command data are prepared to effect the detection of the delivery amounts each time the one-point coating operation has been performed on the predetermined number (N) of the boards 16. The command data are prepared according to a routine illustrated in the flow chart of FIG. 8, which is initiated with step S21 to determine whether the one-point coating operation has been performed at all of the predetermined adhesive-applying spots on the present board 16. This determination in step S21 is effected by determining whether a first COATING COMPLETION flag in the RAM 356 is set in an ON state. This flag in the ON state indicates that the one-point coating operation has been performed on all of the predetermined adhesive-applying spots on the present board 16. The setting of the first COATING COMPLETION flag will be described later. If a negative decision (NO) is obtained in step S21, one cycle of execution of the routine of FIG. 8 is terminated.

If the one-point coating operation has been performed at all of the predetermined adhesive-applying spots on the present board 16, an affirmative decision (YES) is obtained in step S21, and the control flow goes to step S22 to increment a count C1 of a first counter. Since the first counter is reset to zero upon the initial setting, the count C1 is incremented to "1" when step S22 is implemented for the first time. Then, step S23 is implemented to determine whether the count C1 is equal to or larger than a predetermined value CA, which is the predetermined number (N) of the boards 16 described above. Since a negative decision (NO) is initially obtained in step S23, the control flow goes to step S25 to reset a DELIVERY-AMOUNT DETECTION flag to an OFF state. This flag placed in an ON state indicates that the detection of the delivery amounts of the adhesive mass is to be effected. The predetermined number (N) is stored in the RAM 356, as part of various kinds of data used to coat the printed-wiring boards 16 with the adhesive agent.

When the one-point coating operation has been performed on the predetermined number (N) of boards 16, an affirmative decision (YES) is obtained in step S23, and the control flow goes to step S24 to set the DELIVERY-AMOUNT DETECTION flag to the ON state. Thus, the command data to effect the detection of the delivery amounts of the adhesive mass are prepared. Step S24 is followed by step S26 to reset the first counter to zero, and one cycle of execution of the routine of FIG. 8 is terminated.

Figure 7:
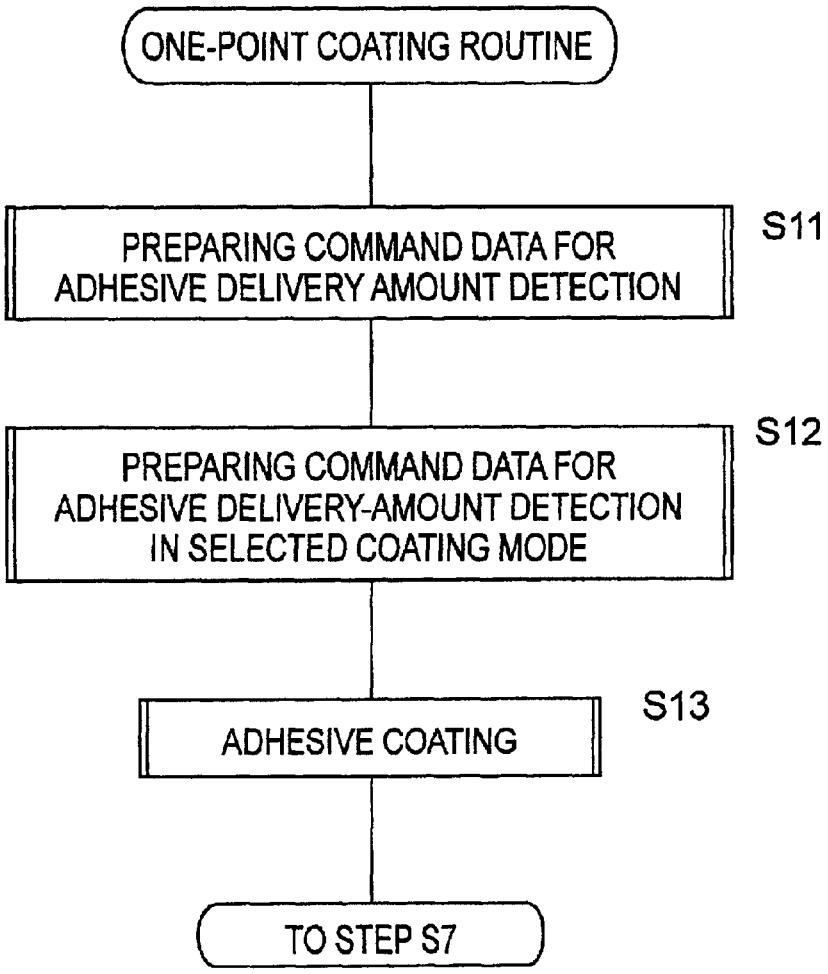
FIG. 7 is a flow chart illustrating a one-point coating routine according to a control program stored in the RAM.
Figure 8:
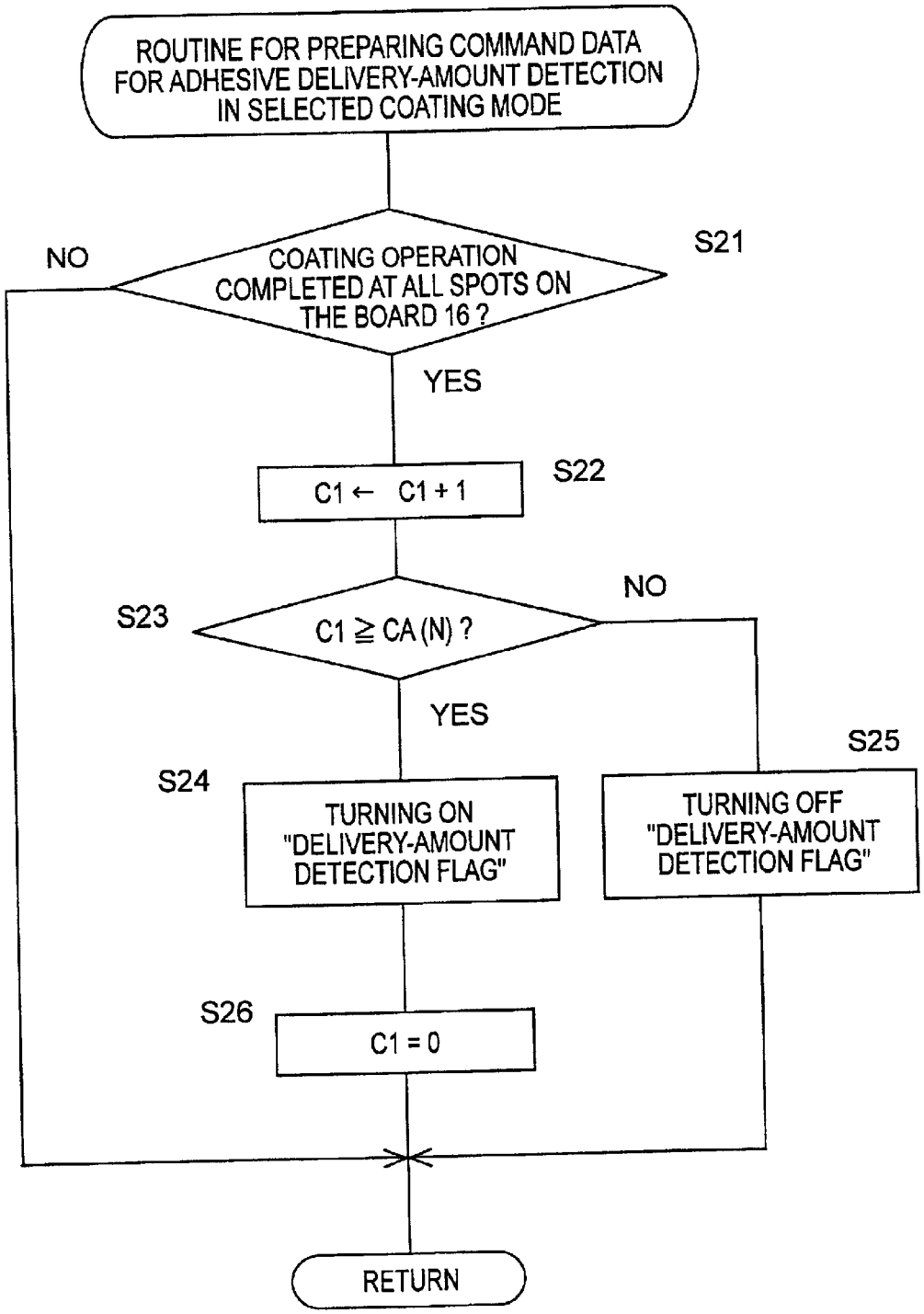
FIG. 8 is a flow chart illustrating a routine executed according to a control program stored in the RAM, for preparing command data for adhesive delivery amount detection.
Figure 9:
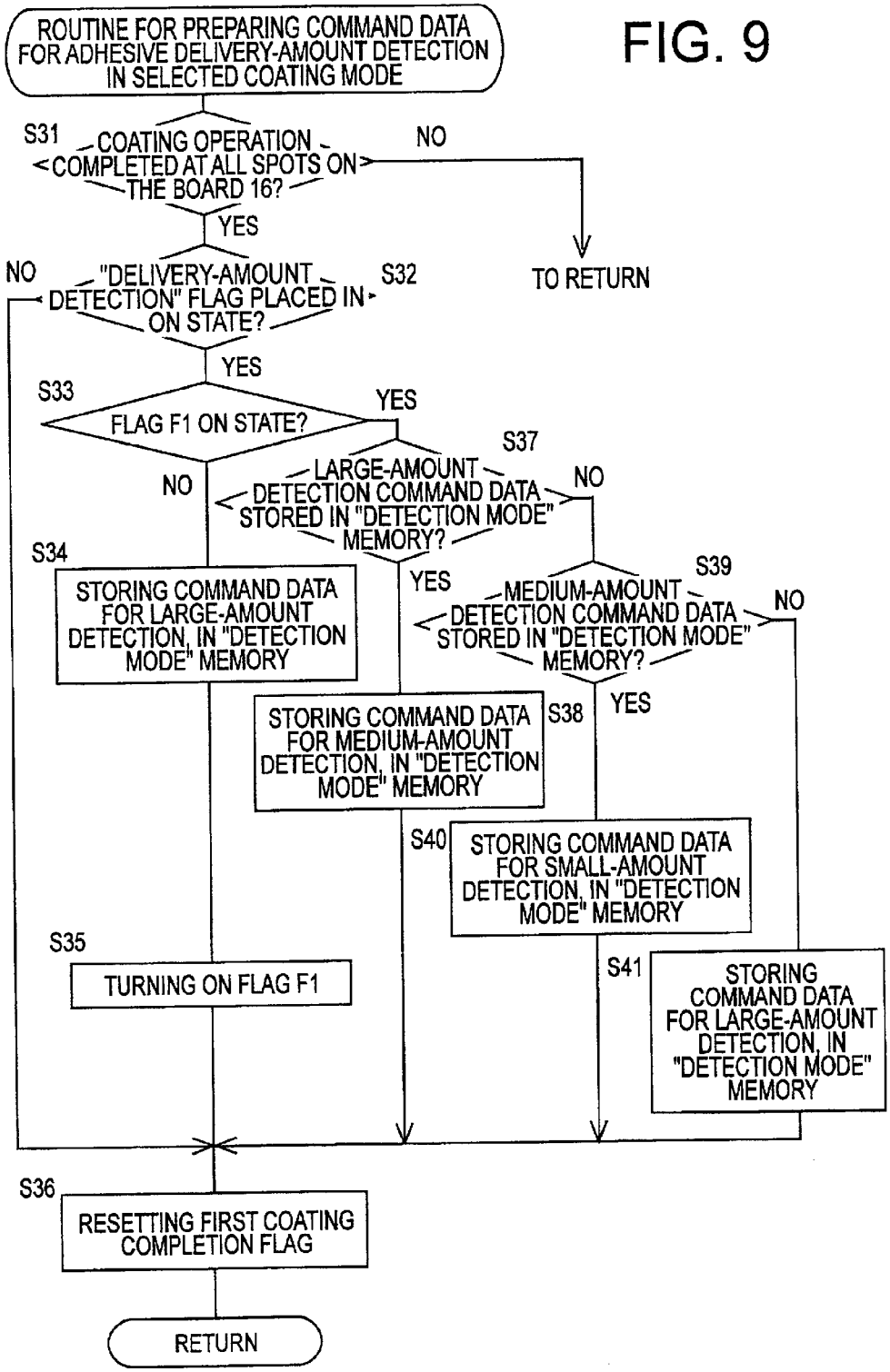
FIG. 9 is a flow chart illustrating a routine executed according to a control program stored in the RAM, for preparing command data for adhesive delivery-amount detection and coating mode.

In the one-point coating routine of FIG. 7, step S11 is followed by step S12 to prepare command data for effecting the detection of the delivery amounts of the adhesive mass in selected one of the large-, medium- and small-amount coating modes. According to the thus prepared command data, the detection of the delivery amounts is effected in the selected coating mode. The command data are prepared according to a routine illustrated in the flow chart of FIG. 9. This routine is initiated with step S31 to determine whether the one-point coating operation has been performed at all of the predetermined adhesive-applying spots on the present board 16. The determination in step S31 is effected depending upon whether the first COATING COMPLETION flag is placed in the ON state or not. If a negative decision (NO) is obtained in step S31, one cycle of execution of the routine of FIG. 9 is terminated.

If the one-point coating operation has been performed at all of the predetermined adhesive-applying spots on the present board 16, an affirmative decision (YES) is obtained in step S31, and the control flow goes to step S32 to determine whether the detection of the delivery amounts of the adhesive mass is to be effected. The determination in step S32 is effected depending upon whether the DELIVERY-AMOUNT DETECTION flag is placed in the ON state. If this flag is not set in the ON state, that is, if a negative decision (NO) is obtained in step S32, the control flow goes to step S36 to reset the first COATING COMPLETION flag to the OFF state, and one cycle of execution of the routine is terminated. Thus, the command data for effecting the detection of the delivery amounts of the adhesive mass in the selected coating mode are not prepared. In other words, the command data are prepared only when the detection of the delivery amounts is to be effected with the DELIVERY-AMOUNT DETECTION flag placed in the ON state.

If the detection of the delivery amounts of the adhesive mass is to be effected, that is, if the DELIVERY-AMOUNT DETECTION flag is placed in the ON state after the one-point coating operation has been performed at all of the predetermined adhesive-applying spots on the present board 16, an affirmative decision (YES) is obtained in step S32, and the control flow goes to step S33 to determine whether a flag F1 is placed in an ON state. This flag F1 placed in the ON state indicates that the detection of the delivery amounts of the adhesive mass is to be effected for the third time, that is, the detection has been effected on the first board 16 and on another board 16 which is the N-th board as counted from the first board 16. The flag F1 is reset to the OFF state upon the initial setting in the main routine, a negative decision (NO) is obtained in step S33 when this step S33 is implemented for the first time, and the control flow goes to sep S34 to prepare command data for effecting the detection of the delivery amounts of the adhesive mass in the large-amount coating mode. That is, the present embodiment is arranged such that the second detection of the delivery amounts following the first detection on the first board 16 is effected in the large-amount coating mode. The thus prepared command data are stored in the DELIVERY-AMOUNT DETECTION MODE memory in the RAM 356. Step S34 is followed by step S35 to set the flag F1 to the ON state, and step S36 to reset the first COATING COMPLETION flag.

Each time the DELIVERY-AMOUNT DETECTION flag is set to the ON state, the affirmative decision (YES) is obtained in step S32, and the control flow goes to step S33. Where the detection of the delivery amounts of the adhesive mass is to be effected for the third and subsequent time, the flag F1 is set in the ON state, so that an affirmative decision (YES) is obtained in step S33, and the control flow goes to steps S37–S41 to prepare command data for effecting the detection of the delivery amounts in the medium-amount coating mode, and the detection of the delivery amounts in the small-amount coating mode. When the command data for effecting the detection in the large-amount coating mode are presently stored in the DELIVERY-AMOUNT DETECTION MODE memory (hereinafter referred to as "DETECTION MODE memory"), that is, if an affirmative decision (YES) is obtained in step S37, the control flow goes to step S38 to prepare the command data for effecting the detection of the delivery amounts in the medium-amount coating mode, and store the prepared command data in the DETECTION MODE memory. When the command data for effecting the detection of the delivery amounts in the medium-amount coating mode are presently stored in the DETECTION MODE memory, that is, if an affirmative decision (YES) is obtained in step S39, the control flow goes to step S40 to prepare command data for effecting the detection in the small-amount coating mode, and store the prepared command data in the DETECTION MODE memory. If the command data for effecting the detection in the small-amount coating mode are stored in the DETECTION MODE memory, a negative decision (NO) is obtained in step S39, and the control flow goes to step S41 to prepare command data for effecting the detection in the large-amount coating mode, and store the prepared command data in the DETECTION MODE memory. Steps S38, S40 and S41 are followed by step S36 to reset the first COATING COMPLETION flag to the OFF state, and terminate one cycle of execution of the routine of FIG. 9. While the detections in the large-amount, medium-amount and small-amount coating modes are effected in this order of description, the detections may be effected in the reverse order.

Figure 10:
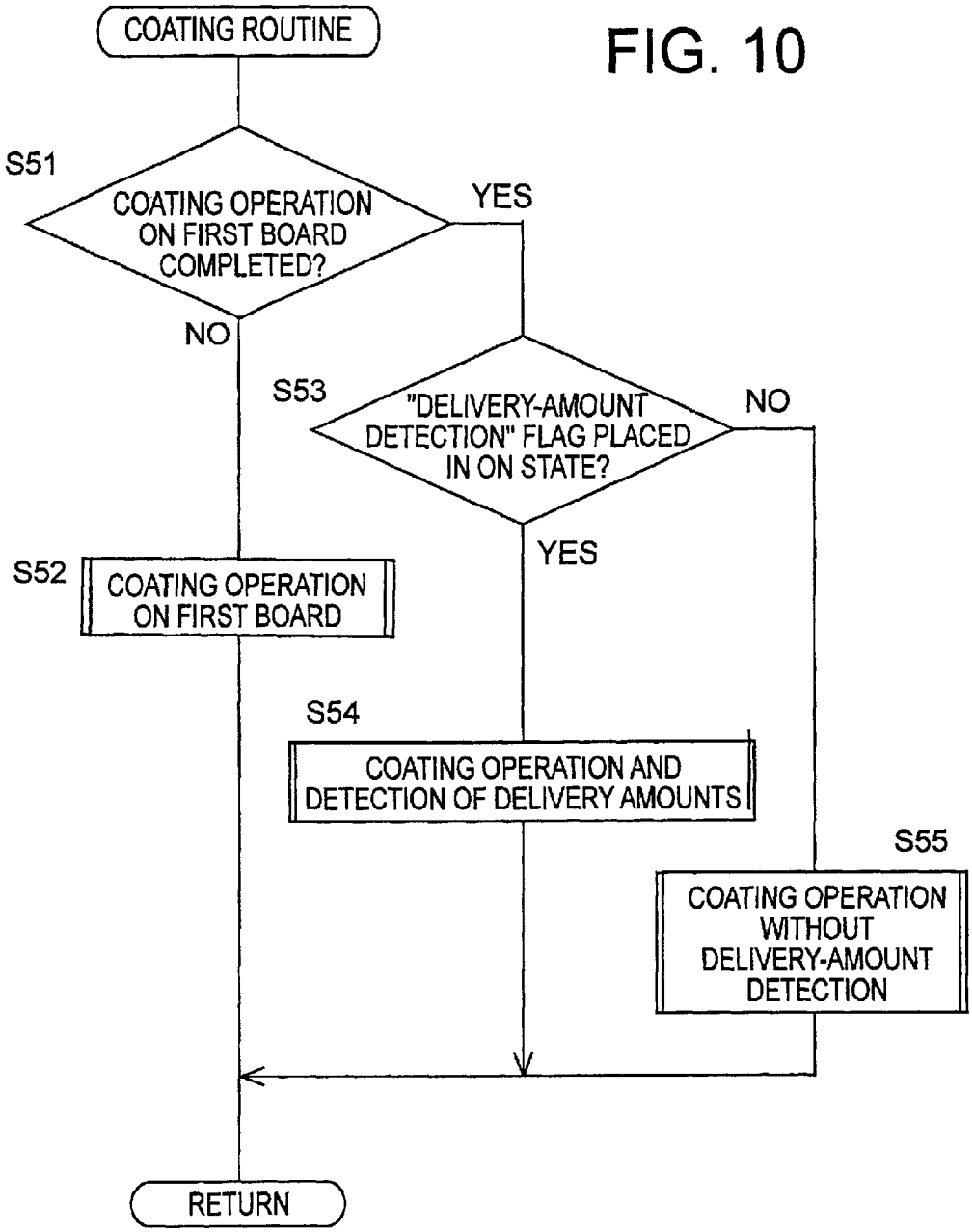
FIG. 10 is a flow chart illustrating a coating routine illustrating a coating routine executed according to a control program stored in the RAM.

Referring back to the one-point coating routine of FIG. 7, step S12 is followed by step S13 in which the adhesive agent is applied to the printed-wiring board 16, according to a coating routine illustrated in the flow chart of FIG. 10. This coating routine is initiated with step S51 to determine whether the one-point coating operation has been performed at all of the predetermined adhesive-applying spots on the first printed-wiring board 16. This determination in step S51 is made by determining whether a second COATING COMPLETION flag of the RAM 356 is placed in an ON state. This flag placed in the ON state indicates that the coating operation on all of the predetermined adhesive-applying spots on the first board 16 has been completed.

If the coating operation has not been performed at all of the predetermined adhesive-applying spots on the first board 16, a negative decision (NO) is obtained in step S51, and the control flow goes to step S52 to perform the one-point coating operation on the first board 16, according to a first-board coating routine illustrated in the flow chart of FIG. 11. If the coating operation at the predetermined adhesive-applying spots on the first board 16 has been performed, an affirmative decision (YES) is obtained in step S51, and the control flow goes to step S53 to determine whether the detection of the delivery amounts of the adhesive mass is to be detected. This determination in step S53 is made depending upon whether the DELIVERY-AMOUNT DETECTION flag is placed in the ON state or not. If an affirmative decision (YES) is obtained in step S53, the control flow goes to step S54 in which the coating operation and the detection of the delivery amounts of the adhesive mass are effected according to a coating and delivery-amount detection routine illustrated in the flow charts of FIGS. 13–15. If a negative decision (NO) is obtained in step S53, the control flow goes to step S55 to perform the coating operation on the printed-wiring board 16, without detection of the delivery amounts of the adhesive mass, according to a routine illustrated in the flow chart of FIG. 16.

The coating operation on the first board 16 will be described referring to the flow chart of FIG. 11. The first-board coating routine of FIG. 11 is initiated with step S61 to determine whether the coating operation in the large-amount coating mode is completed. The determination in step S61 is effected depending upon whether a LARGE-AMOUNT COATING COMPLETION flag in the RAM 356 is placed in an ON state or not. The adhesive agent is applied to a predetermined number of adhesive-applying spots on the board 16 in the large-amount coating mode. If the coating operation in the large-amount coating mode has not performed at all of the predetermined adhesive-applying spots, a negative decision (NO) is obtained in step S61, and the control flow goes to step S62 to increment a count C2 of a second counter of the RAM 356. The second counter is provided to count the number of the adhesive-applying spots at which the coating operation has been performed. Then, the control flow goes to step S63 to perform the coating operation in the large-amount coating mode.

To perform the coating operation, the dispenser unit 30 is moved according to coating-position data of coating data. The coating-position data represent the predetermined coating positions on the board 16. The coating data include other kinds of data such as; the above-described delivery-amount data of the adhesive mass; the above-described angle data of the screw drive motor 240; total-adhesive-applying spot data representative of the total number of the predetermined adhesive-applying spots in each of the three coating modes; detected-adhesive-applying spots data representative of the number of the adhesive-applying spots at which the delivery amounts of the adhesive mass are detected. The three sets of coating-position data corresponding to the respective large-amount, medium-amount and small-amount coating modes are stored in respective LARGE DELIVERY-AMOUNT memory, MEDIUM DELIVERY-AMOUNT memory and SMALL DELIVERY-AMOUNT memory of the RAM 356. The coating-position data for the large-amount coating mode are read out from the LARGE DELIVERY-AMOUNT memory according to the count C2 of the second counter. The coating positions represented by the coating-position data are the positions of the axis of the nozzle body 104 of the delivery nozzle 90. The dispenser unit 30 is moved such that the axis of the nozzle body 104 is successively located at the coating positions. Before the adhesive agent is applied to the printed-wiring board 16, images of a plurality of fiducial marks (not shown) provided on the board 16 are taken by the CCD camera 332, and the errors of the coating positions in the X-axis and Y-axis directions are obtained on the basis of image data representative of the images of the fiducial marks. The obtained X-axis and Y-axis errors of the coating positions are stored in the RAM 356. The movement data to move the dispenser unit 30 to the respective coating positions represented by the coating-position data are compensated for the X-axis and Y-axis errors, to locate the delivery nozzle 90 at the predetermined coating positions with high accuracy, so that the adhesive agent is applied to the adhesive-applying spots corresponding to the coating positions.

After the dispenser unit 30 is stopped at each coating position, the Z-axis slide 70 is lowered until the pin 110 attached to the nozzle body 104 comes into abutting contact with the working surface 32 of the board 16. Described more precisely, the Z-axis slide 70 is moved by a small distance even after the pin 110 comes into abutting contact with the working surface 32. This further movement of the Z-axis slide 70 is permitted by compression of the spring 200, that is, by movements of the delivery nozzle 90, nut 142, sleeve 124, pump housing 180, screw 214, spring sheet 198 and adhesive supply device 98, as a unit, relative to the Z-axis slide 70 against the biasing force of the spring 200. The movements of the sleeve 124, etc. relative to the Z-axis slide 70 are guided by sliding engagement of the pump housing 180 with the guide members 182 and sliding engagement of the sleeve 124 with the driven gear 200.

As described above, the pin 110 extends downwards from the lower end face of the delivery tube 106, and functions to establish a suitable gap between the lower end of the delivery tube 106 and the working surface 32 of the board 16. The relative movements indicated above prevent damages of the pin 110 and the board 16, and an impact upon abutting contact of the pin 110 with the working surface 32 is absorbed by the compression of the spring 200.

In the above-indicated state in which the pin 110 is held in pressing contact with the board 16, the screw 214 is rotated by the screw rotating device 96, so that the delivery nozzle 90 delivers a controlled amount of the adhesive agent onto the board 16. At this time, the operating angle of the screw drive motor 240 is controlled according to the output signal of the encoder 370, so that the screw 214 is rotated by the predetermined angle represented by the angle data stored in the LARGE DELIVERY-AMOUNT memory, whereby the adhesive agent is applied to the adhesive-applying spot, by the predetermined relatively large amount, in the coating operation in the large-amount coating mode in step S63.

In the present embodiment, the solenoid-operated shut-off valve 274 is held in the open state to introduce the compressed air into the air chamber of the container 250, for pressurizing the adhesive agent in the container 250, at least while the adhesive agent is delivered from the delivery nozzle 90 onto the board 16. Accordingly, the supply passages 260, 262, and a helical space between the screw 214 and the inner circumferential surface of the screw chamber 210 are filled with the adhesive agent, without air cavities, so that a rotary motion of the screw 214 causes the adhesive agent to be fed through the helical portion 218 to the delivery port 222, and further fed from the delivery port 222 into the tapered passage 109 of the nozzle body 104. The adhesive mass within the passage 108 is extruded through the delivery tube 106, and delivered onto the working surface 32 of the board 16. The adhesive agent having a relatively high degree of viscosity is fed by the rotating screw 214 to the delivery port 222, and the amount or volume of the adhesive mass to be delivered onto the board 16 can be accurately controlled according to the rotating angle of the screw 214.

Since the screw 214 is substantially fluid-tightly fitted in the screw chamber 210, the adhesive agent will not be fed back towards the adhesive supply device 98 through a gap between the screw 214 and the inner surface of the pump housing 180, so that the predetermined amount of the adhesive mass can be fed to the delivery nozzle 90 with high accuracy, for delivery onto the board 16. Further, the adhesive agent will not leak toward the screw drive motor 240, in the presence of the O-ring 234 between the rotary shaft 230 and the pump housing 180 to secure fluid tightness therebetween. Since the amount of the adhesive mass to be fed by the screw accurately corresponds to the rotating angle of the screw 214, the amount of the adhesive mass to be delivered onto the board 16 can be accurately controlled by controlling the rotating angle of the screw 214.

Further, the temperature of the adhesive agent is maintained at the optimum level by the temperature control device 290, so that the viscosity of the adhesive agent is maintained at a value suitable for delivery onto the board 16 by the predetermined amount. Further, the adhesive mass applied at each of the predetermined adhesive-applying spots has a high degree of consistency in its three-dimensional geometry or profile, owing to the constant amount of gap between the lower end of the delivery tube 106 and the working surface 32, and owing to the optimum temperature of the adhesive mass.

Where the adhesive mass is successively applied to the predetermined adhesive-applying spots, the compressed air is kept supplied by the compressed-air supply device 270 to the container 250. However, the adhesive agent does not leak from the delivery tube 106 between the successive applications of the adhesive mass. In this respect, it is noted that the screw 214 the rotation of which is stopped between the successive applications functions to prevent a flow of the adhesive agent toward the delivery nozzle 90 even while the adhesive agent is kept pressurized by the compressed air in the container 250.

Where the application of the adhesive mass onto the board or boards 16 is interrupted for more than a predetermined time, the supply of the compressed air to the container 250 by the compressed-air supply device 270 is stopped. For instance, the supply of the compressed air is stopped during a time period between the completion of the coating operation on the present board 16 and the initiation of the coating operation on the next board 16, or during a period of setup change including a change of the delivery nozzle from the one-point delivery nozzle 90 to the two-point coating delivery nozzle 160, for instance, when the printed-wiring board 16 is changed from one type to another.

After the adhesive coating operation has been performed at the present adhesive-applying spot, the dispenser unit 30 is moved upwards to lift the delivery nozzle 90 away from the board 16, and the control flow goes to step S64 to determine whether the count C2 of the second counter has exceeded a predetermined value CB, that is, the number of the adhesive-applying spots at which the delivery amount of the adhesive mass has been detected (in step S65) in the large-amount coating mode has reached the predetermined number CB. As described above, the delivery amounts of the adhesive mass in all of the three coating modes are detected for the first board 16, and the predetermined number CB is smaller than the predetermined total numbers of the adhesive-applying spots in the three coating modes. In each of these modes, the delivery amounts are detected at predetermined numbers of selected ones of the total numbers of the adhesive-applying spots, which predetermined numbers are counted from the first adhesive-applying spot. Step S64 is provided to determine whether the delivery amount of the adhesive mass in the large-amount coating mode has been detected at the predetermined number (CB) of the adhesive-applying spots as counted from the first adhesive-applying spot.

A negative decision (NO) is initially obtained in step S64, and the control flow goes to step S65 in which an image of the adhesive mass applied to the present adhesive-applying spot is taken by the CCD camera 332 which is positioned right above the adhesive mass applied to the board 16. This positioning of the CCD camera 332 is achieved according to the coating-position data and an offset distance between the CCD camera 332 and the delivery nozzle 90 in the X-axis direction. Image data representative of the taken image are fed to the computer 360, and the computing portion of the computer 360 processes the image data to calculate the surface area of the outer profile of the applied adhesive mass, and store the calculated surface area in a DELIVERY AMOUNT memory of the RAM 356.

Steps S51–S65 are repeatedly implemented until the delivery amount of the adhesive mass in the large-amount coating mode has been detected at the predetermined number CB. That is, an affirmative decision (YES) is obtained in step S64 when the large-amount coating operation has been performed after the number of the adhesive-applying spots at which the delivery amount has been detected has reached the predetermined value CB. In this case, the control flow goes to step S66 to determine whether a processing in the following step S67 was completed, that is, whether processing operations including a determination as to whether an adjustment of the rotating angle of the screw 214 is necessary to adjust the delivery amount of the adhesive mass to the desired value have been completed. This determination in step S66 is effected depending upon whether a COATING-CONDITION ADJUSTMENT DETERMINATION flag of the RAM 356 is set in an ON state. Since this flag is initially reset to an OFF state, a negative decision (NO) is initially obtained in step S66, and the control flow goes to step S67 to determine whether the calculated delivery amount of the adhesive mass is substantially equal to the desired value, to adjust the rotating angle of the screw 214 if necessary to adjust the actual delivery amount, and to set the COATING-CONDITION ADJUSTMENT DETERMINATION flag to the ON state.

The determination as to whether the actual delivery amount of the adhesive mass is substantially equal to the desired value is effected according to the surface areas of the adhesive masses applied at the predetermined number (CB) of adhesive-applying spots, which surface areas were calculated in step S65 and stored in the DELIVERY AMOUNT memory. In the present embodiment, an average of the calculated surface areas of the outer profiles of the adhesive masses is calculated, and is compared with a desired value corresponding to the desired delivery amount. If the average of the calculated surface areas is smaller than the desired value by more than a predetermined amount, it is determined that the actual delivery amount is insufficient. In other words, the determination as to whether the actual delivery amount is substantially equal to the desired value is effected by determining whether the above-indicated average surface area is held within a predetermined permissible range whose upper and lower limits are determined by the desired value of the surface area. The desired amount of the adhesive mass in the large-amount coating mode is stored in the LARGE DELIVERY-AMOUNT memory of the RAM 356. If the actual delivery amount is determined to be insufficient, the operating angle of the screw drive motor 240 in the coating operations on the second and subsequent boards 16 is increased by an amount corresponding to a difference between the actual delivery amount and the desired value (a difference between the obtained average of the calculated surface areas and the desired value). Thus, the rotating angle of the screw 214 is adjusted by an amount corresponding to the difference between the average of the actual delivery amounts and the desired value of this average, if the difference is larger than a predetermined amount, so that the actual delivery amount of the adhesive mass is adjusted to the desired value.

If the average of the calculated surface areas is large than the desired value by more than a predetermined amount, it is determined that the actual delivery amount is excessively large, namely, the rotating angle of the screw 214 is excessively large. In this case, the operating angle of the screw drive motor 240 in the coating operations on the second and subsequent boards 16 is reduced by an amount corresponding to a difference between the actual average and the desired value. The angle data representative of the thus adjusted operating angle of the screw drive motor 240 are stored in the LARGE DELIVERY-AMOUNT memory, together with the angle data before the adjustment. This memory has a first memory area for storing the angle data representative of the operating angle of the motor 240 used in the actual coating operation, and a second memory area for storing the angle data representative of the operating angle adjusted in step S67. The angle data stored in the first memory area represent an initial value of the operating angle of the motor 240 in the coating operation on the first board 16, so that the motor 240 is initially operated according to the angle data stored in the first memory area, to apply the adhesive agent on the first board 16.

If the average of the calculated surface areas of the outer profiles of the applied adhesive masses is held within the predetermined permissible range, the actual delivery amounts are determined to be substantially equal to the desired value. In this case, the operating angle of the screw drive motor 240 is not adjusted or compensated, and the COATING-CONDITION ADJUSTMENT DETERMINATION flag is set to the ON state. It is noted that the determination in step S67 as to whether the actual delivery amount is substantially equal to the desired value may be effected in any other manner, according to a suitable statistical processing technique. Further, the actual delivery amount may be determined to be insufficient or excessive, if the actual delivery amount at any one of the predetermined adhesive-applying spots in question is not substantially equal to the desired value.

Step S67 is followed by step S68 to determine whether the count C2 of the second counter is equal to or larger than a predetermined value C1, that is, whether the number of the adhesive-applying spots at which the coating operation in the large-amount coating mode has been performed has reached the predetermined total number C1. Initially, a negative decision (NO) is obtained in step S68, and one cycle of execution of the first-board coating routine is terminated. In the next cycle of execution of the present routine, an affirmative decision (YES) is obtained in step S66 since the processing in step S67 was implemented in step S67 in the last cycle of execution. Accordingly, the control flow goes to step S68 while skipping step S67. Steps S61–S64, S66 and S68 are repeatedly implemented until the coating operation in the large-amount coating mode has been performed at all of the predetermined number (C1) of adhesive-applying spots. The rotating angle of the screw drive motor 240 in the coating operation on the first board 16 is kept at the initial value, even if the angle data representative of the adjusted rotating angle was stored in the second memory area of the LARGE DELIVERY-AMOUNT memory in step S67.

When the adhesive mass has been applied to all of the predetermined number of adhesive-applying spots in the large-amount coating mode, an affirmative decision (YES) is obtained in step S68, and the control flow goes to step S69 to set the LARGE-AMOUNT COATING COMPLETION flag to the ON state, and reset the second counter, the COATING-CONDITION ADJUSTMENT DETERMINATION flag, etc. In the next cycle of execution of the routine, therefore, an affirmative decision (YES) is obtained in step S61, and the control flow goes to steps S70–S78 to apply the adhesive agent in the medium-amount coating mode, take the images of the applied adhesive masses, calculate the actual delivery amount of the adhesive mass and effect a determination as to whether the calculated actual delivery amount in the medium-amount coating mode is substantially equal to the desired value. If the actual delivery amount is insufficient or excessively large, the angle data representative of the operating angle of the screw drive motor 204 are stored in a MEDIUM DELIVERY-AMOUNT memory. Then, steps S79–S85 are implemented to apply the adhesive agent in the small-amount coating mode, and effect processing operations similar to those in the large- and medium-amount coating modes described above. When the coating operation in the small-amount coating mode has been performed at all of the predetermined number of adhesive-applying spots, the control flow goes to step S86 to set the first and second COATING COMPLETION flags to the ON state, reset the second counter, COATING-CONDITION ADJUSTMENT DETERMINATION flag, etc., and update the angle data stored in the first memory area of a SMALL DELIVERY-AMOUNT memory.

Described more specifically, the angle data stored in the first memory area of the LARGE DELIVERY-AMOUNT memory are replaced, in step S86, by the angle data which are stored in the second memory area and which represent the adjusted rotating angle of the screw drive motor 240. Accordingly, the coating operations on the second and subsequent boards 16 are performed according to the angle data stored in the updated angle data stored in the first memory area, so that the screw drive motor 240 is operated by the adjusted operating angle. With the replacement of the angle data in the first memory area by the angle data in the second memory area, the second memory area is cleared to erase the angle data. However, step S86 may be modified to store data indicative of the adjustment of the operating angle of the motor 240, so that the subsequent coating operations are performed according to the adjusted operating angle.

Figure 12:
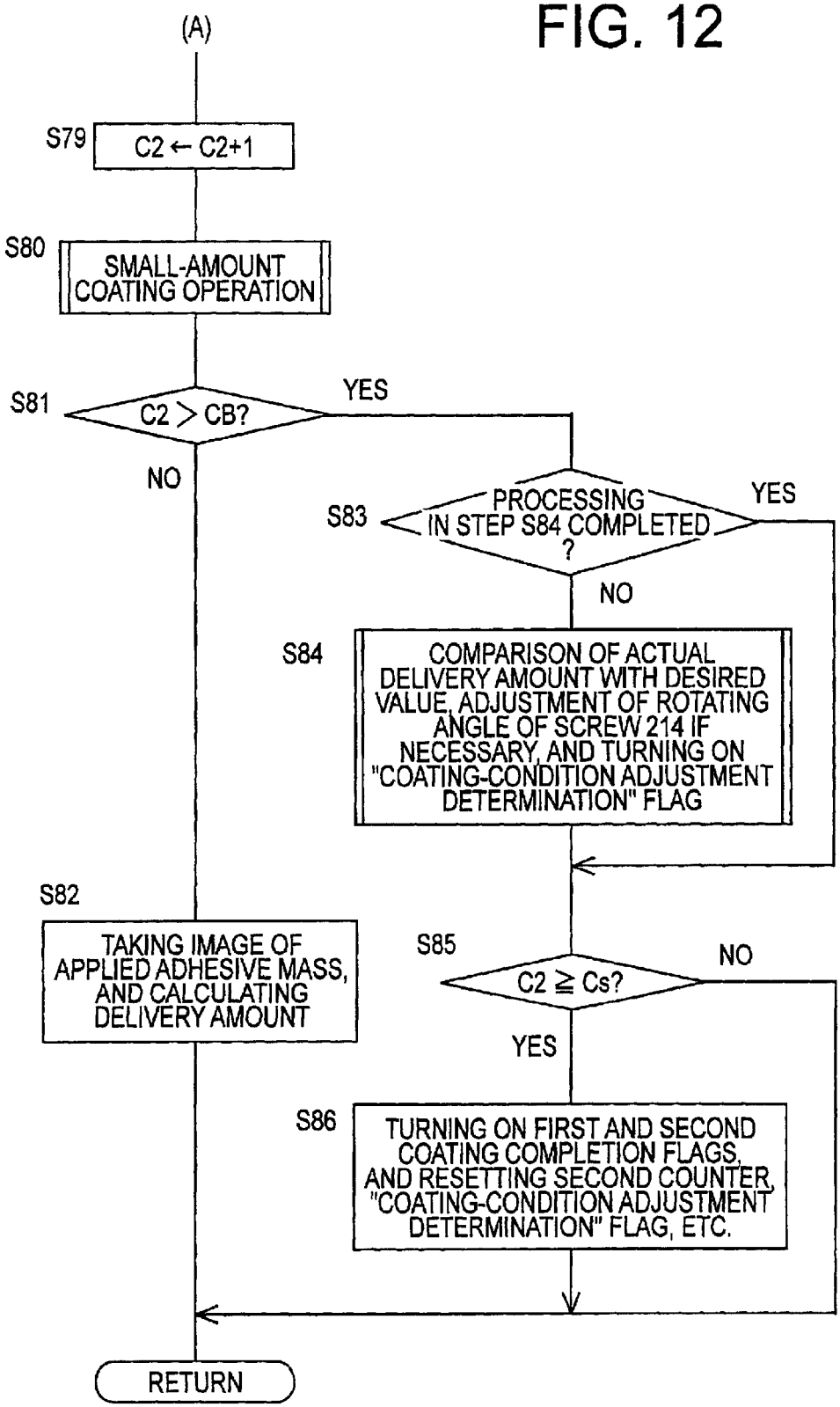

In the first-board coating routine of FIGS. 11 and 12, the determination in steps S66, S75 and S83 as to whether the actual delivery amount of the adhesive mass is substantially equal to the desired value is effected when the count C2 has exceeded the predetermined value CB, more precisely, has increased to a sum (CB+1). However, the determination in steps S66, S75 and S83 may be effected immediately after the coating operation has been performed at all of the predetermined number (CB) of adhesive-applying spots. For instance, step S63 is followed by step S66. If the negative decision (NO) is obtained in step S66, the control flow first goes to step S65, and then to a step to determine whether the count C2 has reached the predetermined value CB. If the count C2 has reached the predetermined value CB, the control flow goes to step S67 to determine whether the actual delivery amount is substantially equal to the desired value, and then to step S69 to set the LARGE-Amount COATING completion flag to the ON state. Subsequently, steps S61–S63, S66, S68 and S69 are repeatedly implemented without implementation of steps S65, S67, until the count C2 has reached the predetermined value C1.

After the second COATING COMPLETION flag has been set to the ON state, an affirmative decision (YES) is obtained in step S51 of the coating routine of FIG. 10, and the control flow goes to step S53 to determine whether the DELIVERY-AMOUNT DETECTION flag is placed in the ON state, that is, whether the detection of the delivery amounts of the adhesive masses is to be detected after the coating operations have been performed on the predetermined number (N) of the boards 16. If an affirmative decision (YES) is obtained in step S53, the control flow goes to step S54 to perform the coating operation and detect the delivery amounts of the adhesive masses applied to the board 16 in question.

Figure 14:
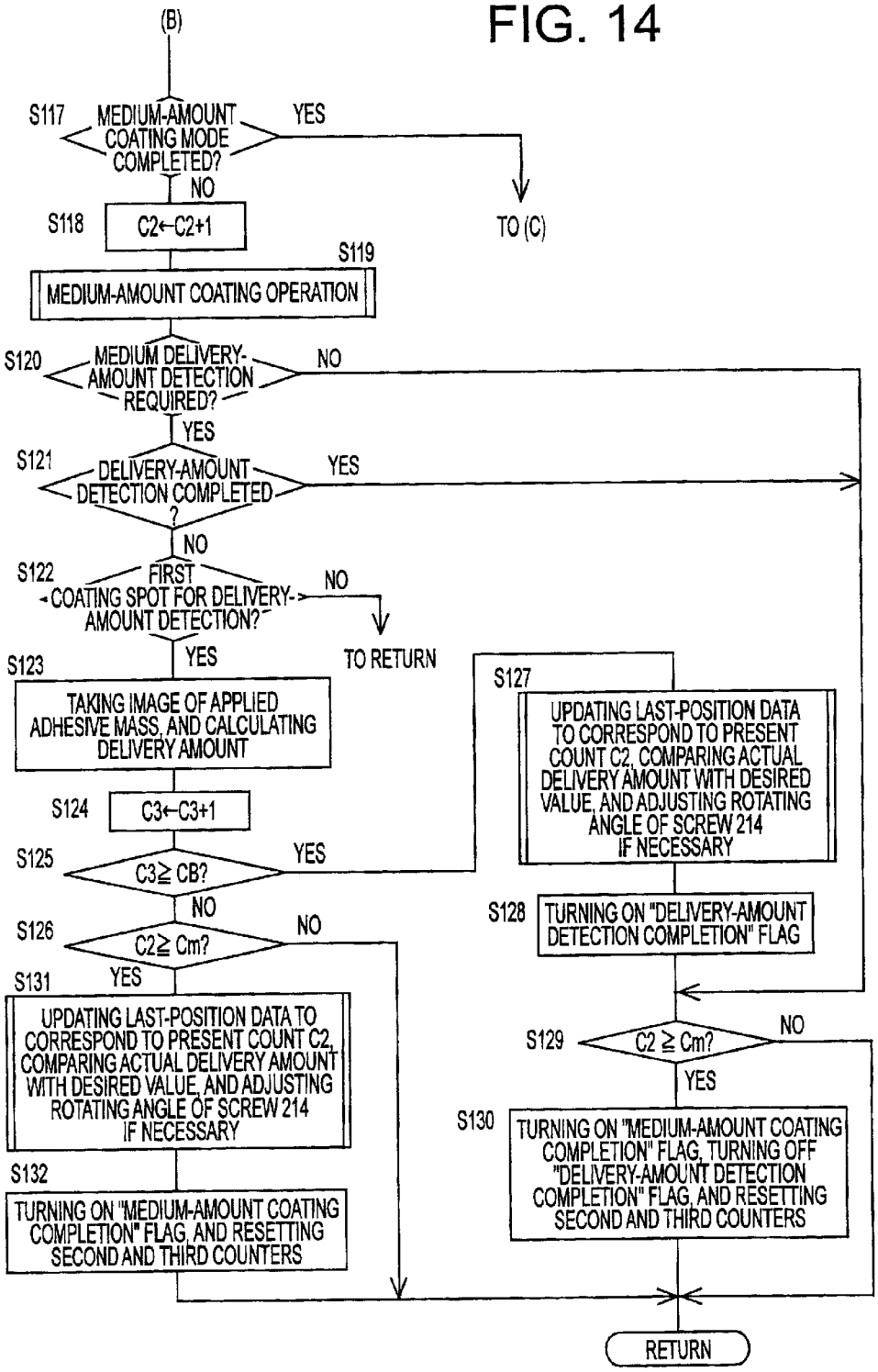
Figure 15:
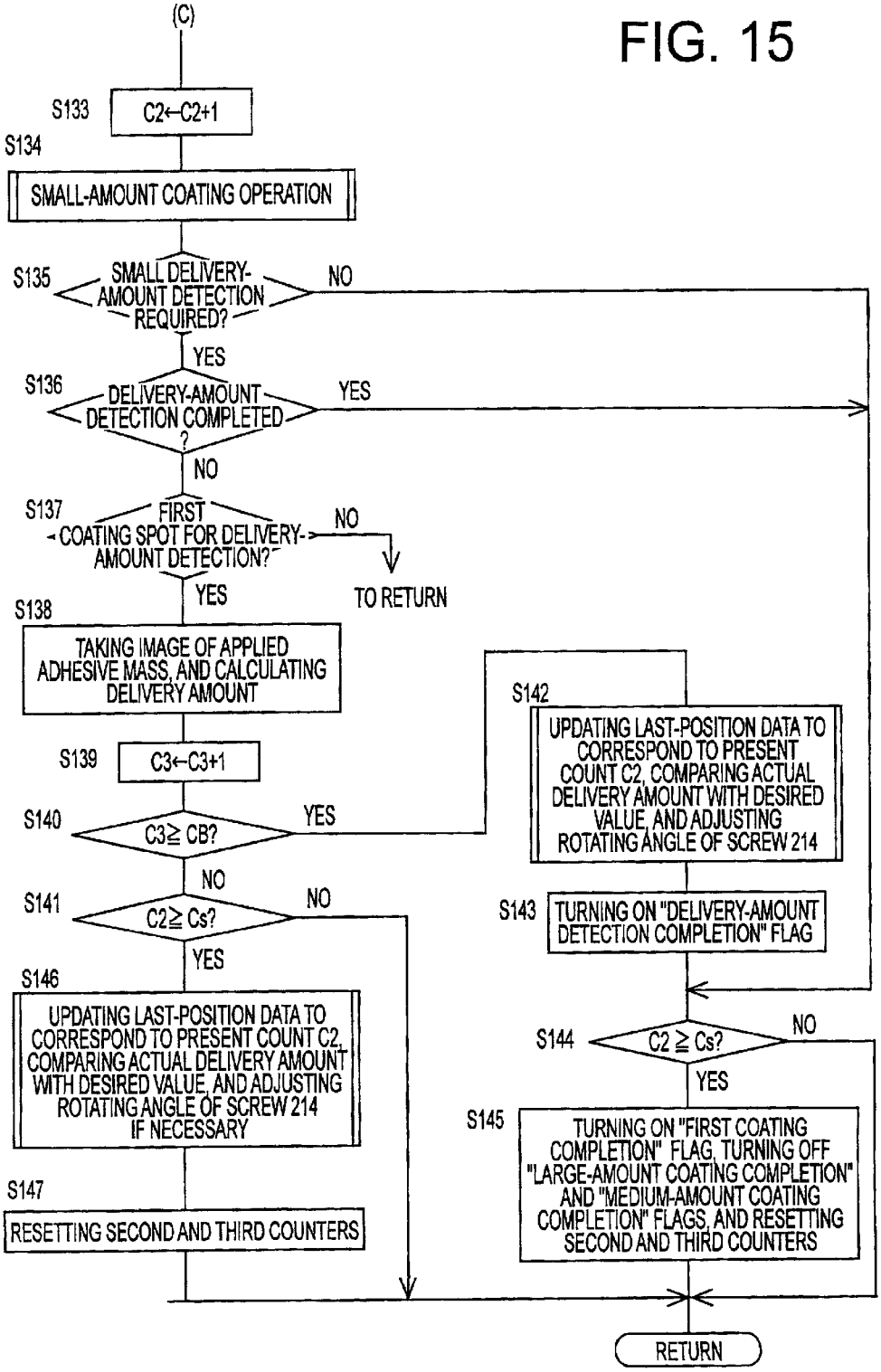

The coating operation and the detection of the delivery amounts in step S54 will be described referring to the flow charts of FIGS. 13–15, which illustrate a coating and delivery-amount detection routine. This routine is different from the first-board coating routine in that the detection of the delivery amount of the adhesive mass is effected in only one of the three coating modes, which is sequentially selected depending upon the board 16, and in that the adhesive-applying spots at which the delivery amount is detected in each coating mode are changed depending upon the board 16. The routine of FIGS. 13–15 is initiated with steps S101–S103 which are identical with steps S61–S63. Then, the control flow goes to step S104 to determine whether it is required to detect the delivery amounts of the adhesive masses applied in the large-amount coating mode. This determination is effected according to the command data stored in the DELIVERY-AMOUNT DETECTION MODE memory of the RAM 356. If the detection of the delivery amount in the large-amount coating mode is required on the present board 16, that is, if an affirmative decision (YES) is obtained in step S104, the control flow goes to step S105 to determine whether the detection of the delivery amounts is completed. This determination is effected depending upon whether a DELIVERY-AMOUNT DETECTION COMPLETION flag of the RAM 356 is placed in the ON state.

If the detection of the delivery amounts is not completed, a negative decision (NO) is obtained in step S105, and the control flow goes to step S106 to determine whether it is required to initiate the detection of the delivery amounts, that is, whether the adhesive-applying spot at which the adhesive mass has been applied in step S105 is the first one of the predetermined adhesive-applying spots at which the delivery amounts of the applied adhesive masses are to be detected. As described, the adhesive-applying spots at which the delivery amounts are detected in each coating mode are changed with a change of the board 16 on which the detection is effected. To this end, a LAST LARGE-AMOUNT DETECTING POSITION memory is provided to store last-position data representative of the last coating position at which the delivery amount upon the last application of the adhesive mass was detected in the large-amount coating mode. The detection of the delivery amount upon the next application of the adhesive mass in the large-amount coating mode is initiated at the adhesive-applying spot next to the last coating position represented by the last-position data stored in the LAST LARGE-AMOUNT DETECTING POSITION memory. The last-position data are updated according to the count C2 of the second counter. The determination in step S106 is effected by determining whether the count C2 has become equal to a sum of the number of the last coating position represented by the last-position data and "1". The final-position data initially stored in the LAST LARGE-AMOUNT DETECTION POSITION memory represent the last adhesive-applying spot at which the detection in the large-amount coating mode was effected on the first board 16 in the first-board coating routine of FIGS. 11 and 12. The initial setting of the last-position data may be made upon initial setting in the main routine, or in step S67 of the first-board coating routine. For the last-position data in the medium- and small-amount coating modes, the RAM 356 further includes a LAST MEDIUM-AMOUNT DETECTION POSITION memory and a LAST SMALL-AMOUNT DETECTION POSITION memory, respectively. The initial setting of the last-position data stored in these memories may be made in steps S76 and S84 of the first-board coating routine, respectively. The last-position data may represent coating position number "0", so that the count C2 of the second counter is incremented to "1" in step S102 when this step is implemented for the firs time. If the count C2 has increased to the predetermined value at which the detection of the delivery amounts is to be initiated, a negative decision (NO) is obtained in step S106, and one cycle of execution of the present routine is terminated.

When the coating operation in the large-amount coating mode has been performed on the predetermined first adhesive-applying spot for the detection of the delivery amount, an affirmative decision (YES) is obtained in step S106, and the control flow goes to step S107 to take the image of the applied adhesive mass, and detect the delivery amount of the applied adhesive mass, as in step S65. Then, the control flow goes to step S108 to increment a count of a third counter of the RAM 356 to count the number of the adhesive-applying spots at which the detection of the delivery amounts has been completed. Step S108 is followed by step S109 to determine whether the count C3 of the third counter has reached the predetermined value CB. Since a negative decision (NO) is initially obtained in step S109, the control flow goes to step S110 similar to step S68, to determine whether the count C2 of the second counter has increased to the predetermined value C1, that is, whether the coating operation in the large-amount coating mode has been performed at all of the predetermined number (C2) of adhesive-applying spots. If a negative decision (NO) is obtained in step S110, one cycle of execution of the present routine is terminated.

If the detection of the delivery amounts at the predetermined number (CB) of adhesive-applying spots is completed before or when the coating operation in the large-amount coating mode is completed (before an affirmative decision is obtained in step S110), an affirmative decision (YES) is obtained in step S109, and the control flow goes to step S111 to update the last-position data stored in the LAST LARGE-AMOUNT DETECTING POSITION memory such that the updated last-position data represent the last adhesive-applying spot corresponding to the present count C2. Like sep S67, step S111 is formulated to determine whether the detected actual delivery amount is substantially equal to the desired value, and adjust the operating angle of the screw drive motor 240 if the actual delivery amount is insufficient or excessively large. Step S112 is then implemented to set the DELIVERY-AMOUNT DETECTION COMPLETION flag to the ON state. Step S112 is followed by step S113 to determine whether the coating operation in the large-amount coating mode has been performed at all of the predetermined adhesive-applying spots. The determination in step S112 is made depending upon whether the count C2 of the second counter has increased to the predetermined value C1. If a negative decision (NO) is obtained in step S113, one cycle of execution of the present routine is terminated. In the next cycle of execution of the routine, an affirmative decision (YES) is obtained in step S105 since the DELIVERY-AMOUNT DETECTION COMPLETION flag was set to the ON state in the last cycle of execution. Accordingly, the control flow goes to step S113. Steps S101–S105 and S113 are repeatedly implemented until the coating operation in the large-amount coating has been performed at all of the predetermined number (C1) of adhesive-applying spots. If an affirmative decision (YES) is obtained in step S113, the control flow goes to step S114 to set the LARGE-AMOUNT COATING COMPLETION flag to the ON state, reset the DELIVERY-AMOUNT DETECTION COMPLETION flag to the OFF state, and reset the second and third counters.

If the coating operation in the large-amount coating mode has been performed at all of the predetermined adhesive-applying spots before the detection of the delivery amounts at the predetermined number (CB) of adhesive-applying spots is completed, an affirmative decision (YES) is obtained in step S110 before an affirmative decision (YES) is obtained in step S109. In this case, step S115 similar to step S111 is implemented to update the last-position data in the LAST LARGE-AMOUNT DETECTING POSITION memory such that the updated last-position data correspond to the present count C2, and adjust the operating angle of the screw drive motor 240 if the detected actual delivery amount is insufficient or excessively large. Accordingly, the next detection of the delivery amount in the large-amount coating mode is initiated at the first adhesive-applying spot. Step S115 is followed by step S116 to set the LARGE-AMOUNT COATING COMPLETION flag to the ON state, and reset the second and third counters.

Since the LARGE-AMOUNT COATING COMPLETION flag is now set in the ON state, an affirmative decision (YES) is obtained in step S101 in the next cycle of execution of the present routine, so that the coating operations are performed in the medium-amount and small-amount coating modes according to the flow charts of FIGS. 14 and 15, respectively. Since the detection of the delivery amounts of the adhesive masses applied to the present board 16 is effected in only the large-amount coating mode, the detection of the delivery amounts is not effected in the medium- and small-amount coating modes, so that a negative decision (NO) is obtained in steps S120 and S135. Accordingly, the coating operations are performed in the medium- and small-amount coating modes, without detection of the delivery amount of the applied adhesive masses. When the coating operation in the small-amount coating mode is completed, step S145 is implemented to set the first COATING COMPLETION flag to the ON state, for indicating the completion of the coating operations on the present board 16, and to reset the DELIVERY-AMOUNT DETECTION COMPLETION flag, LARGE-AMOUNT COATING COMPLETION flag, MEDIUM-AMOUNT COATING COMPLETION flag, and the second and third counters.

Figure 16:
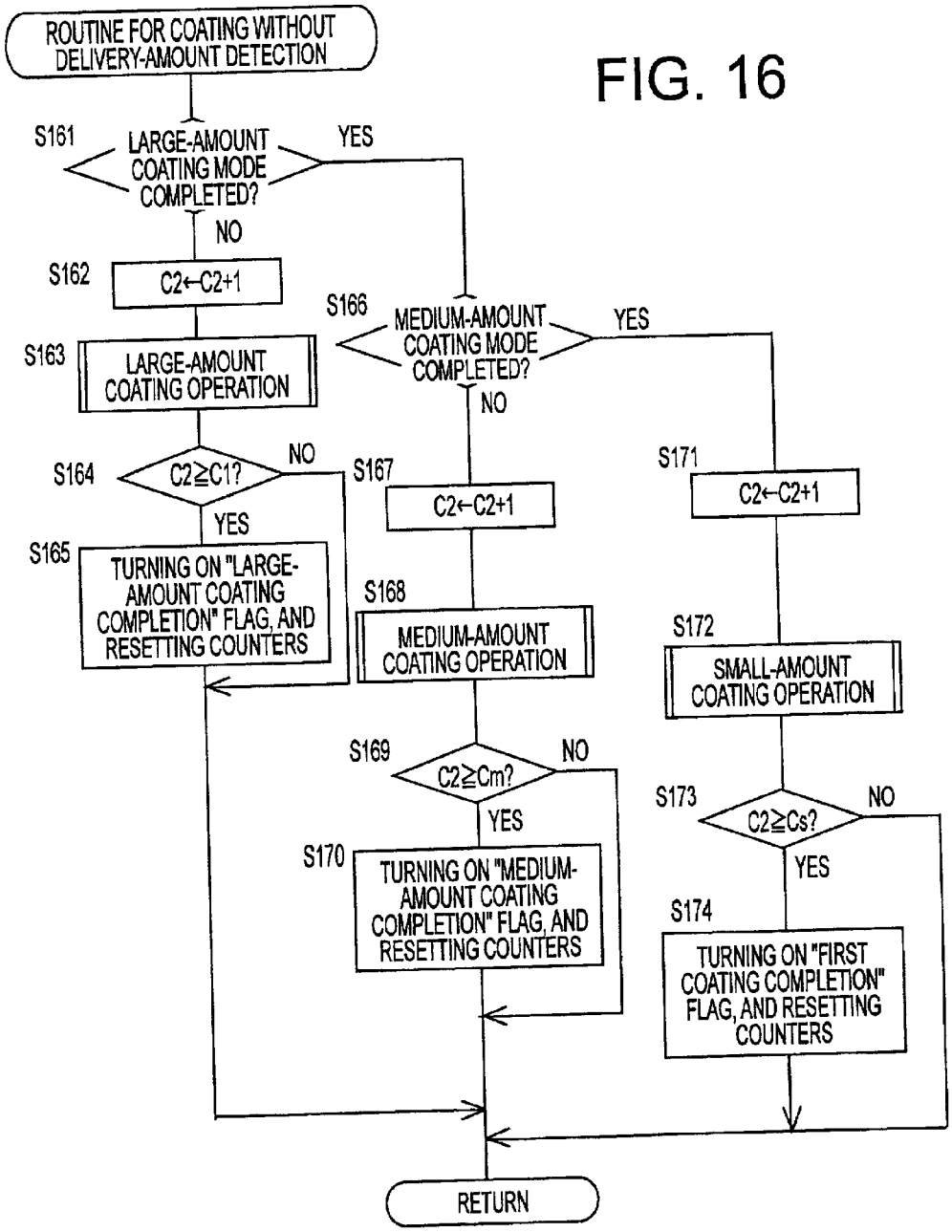
FIG. 16 is a flow chart illustrating a routine executed according to a control program stored in the RAM, for effecting a coating operation without adhesive delivery-amount detection
Figure 17:
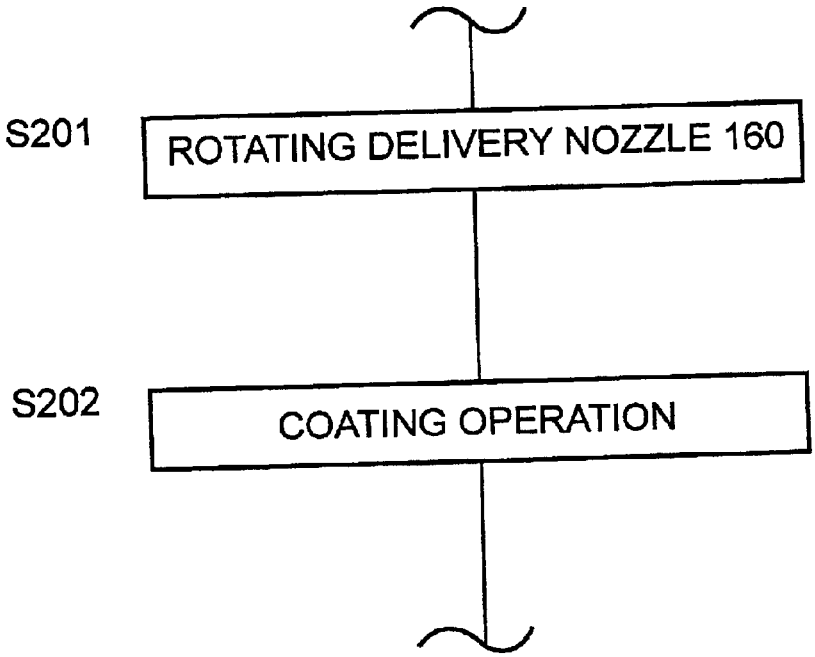
FIG. 17 is a flow chart illustrating a part of a two-point coating routine executed according to a control program stored in the RAM.

While the detection of the delivery amount in the large-amount coating mode has been described above, the detections in the medium-amount and small-amount coating modes are effected in the same manner. Step S146 is implemented when the coating operation in the small-amount coating mode is completed, that is, at the end of the series of coating operations at all of the predetermined adhesive-applying spots on the present board 16 for which the delivery amount is detected. Step S146 is provided to update the last-position data to correspond to the present count C2, compare the detected actual delivery amount with the desired value, and adjust the operating angle of the screw drive motor 240 if necessary. On of the large-, medium- and small-amount coating modes in which the detection of the delivery amount of the adhesive mass has been effected can be known from the command data presently stored in the DELIVERY-AMOUNT DETECTION MODE memory of the RAM 356. If the angle data are stored in the second memory area of any one of the LARGE, MEDIUM and SMALL DELIVERY-AMOUNT memories, the angle data stored in the first memory area are replaced by the angle data which are stored in the second memory area and which represent adjusted operating angle of the screw drive motor 240, so that the screw drive motor 240 is operated by the adjusted operating angle when the coating operations are performed on the next printed-wiring board 16. After the replacement of the angle data, the second memory area of the DELIVERY-AMOUNT memory in question is cleared.

Where only the coating operation is performed without the detection of the delivery amount of the applied adhesive mass, a negative decision (NO) is obtained in step S53 of the coating routine of FIG. 10, and the control flow goes to step S55 to perform the coating operation according to a routine illustrated in the flow chart of FIG. 16. This routine is identical with the coating and delivery-amount detection routine of FIGS. 13–15, except for the elimination of the steps of detecting the delivery amounts of the applied adhesive masses and calculating the amount of adjustment of the operating angle of the screw drive motor 240, and the related steps.

If the angle data stored in the first memory area of any of the three DELIVERY-AMOUNT memories corresponding to the three coating modes have been updated to adjust the operating angle of the screw drive motor 240 since the detected delivery amount of the adhesive mass is outside the predetermined permissible range, as described above, the motor 240 is operated by the angle represented by the updated angle data, in the subsequent coating operations. Thus, the rotating angle of the screw 214 is adjusted to automatically increase or reduce the delivery amount of the adhesive agent from the delivery nozzle 90, so that the amount of the adhesive agent to be applied to the board 16 can be accurately controlled to the desired value. Namely, the operating angle of the screw drive motor 240 in each of the large-, medium- and small-amount coating modes is adjusted to adjust the rotating angle of the screw 214, according to the angle data which are stored in the corresponding DELIVERY-AMOUNT memory and which are updated so as to reduce the difference between the actual delivery amount of the adhesive agent and the desired value. The angle data updated as a result of the detection of the delivery amounts in the three coating modes are effective for the coating operations which will be performed after the detection of the delivery amounts, that is, for the coating operations on the boards 16 following the board 16 for which the detection was effected. However, the updated angle data may be made effective for the present board 16, more precisely, for the coating operations to be performed immediately after the angle data have been updated.

While the coating operations with the one-point coating delivery nozzle 90 and the detection of the delivery amount of the adhesive agent from this delivery nozzle 90 have been described above, the two-point coating delivery nozzle 160 is mounted on the nozzle rotating device 92, in pace of the one-point coating delivery nozzle 90, where the adhesive agent is applied to two adhesive-applying spots at one time with the dispenser unit 30 located at each coating position. In this case, an affirmative decision (YES) is obtained in step S7 of the main routine of FIG. 6, and the control flow goes to step S9 in which the coating operation is performed with the delivery nozzle 160.

The coating operation with the two-point coating delivery nozzle 160 according to the second embodiment is identical with that with the one-point coating delivery nozzle 90, except for angular positioning of the delivery nozzle 160 about its axis to control the two adhesive-applying spots in the circumferential direction of the delivery nozzle 160. The two delivery tubes 162 of the delivery nozzle 160 are located at the respective two circumferential positions of the delivery nozzle 160, which are opposed to each other in a diametric direction of the delivery nozzle 160. This diametric direction in which the two delivery tubes 162 are opposed to each other in the XY plane is changed by rotating the delivery nozzle 160 about its axis with the nozzle rotating device 92. Accordingly, by rotating the delivery nozzle 160, the two adhesive-applying spots on the horizontally extending working surface 32 of the board 16 can be changed with respect to the vertically extending axis of the delivery nozzle 160. This aspect of the coating operation with the two-point coating delivery nozzle 160 will be briefly described referring to the flow chart of FIG. 16.

The angular positions of the delivery nozzle 160 about its axis with respect to a predetermined reference angular position are predetermined for all of its predetermined coating positions in the XY plane, and angular-position data representative of those predetermined angular positions are stored as part of coating data to perform the coating operation with the delivery nozzle 160. As shown in the flow chart of FIG. 17, step S201 is implemented to first operate the nozzle rotating device 92 for rotating the delivery nozzle 160 about its axis to the predetermined angular position corresponding to the present coating position in the XY plane. Step S201 is followed by step S202 in which the adhesive masses are concurrently applied from the two delivery tubes 162 to the respective two adhesive-applying spots on the printed-wiring board 16. These steps S201 and S202 are repeatedly implemented for all of the predetermined coating positions. The adhesive agent is fed from the screw chamber 210 to the two delivery tubes 162 through the delivery port 222, common passage 170 and two passages 168, so that the adhesive masses are concurrently delivered from the two delivery tubes 162 onto the board 16, at the respective two adhesive-applying spots on the working surface 32. In step S201, the delivery nozzle 160 is rotated relative to the pump housing 180, with the nozzle body 164 being rotated by the driven gear 120. The portion of the pump housing 180 which is fitted in the nozzle body 164 functions as a support shaft for rotatably supporting the driven gear 120. Like the one-point coating operation, the two-point coating operation with the two-point coating delivery nozzle 160 is performed with operations to detect the delivery amounts of the adhesive masses, compare the detected delivery amount with the desired value, and update the angle data to adjust the operating angle of the screw drive motor 240 if necessary. In the present second embodiment, the two delivery tubes 162 have the same size and configuration, and the images of the two adhesive masses applied by the respective two delivery tubes 162 are concurrently taken by the CCD camera 332. An average of the surface areas of the outer profiles of the adhesive masses at a predetermined number of pairs of adhesive-applying spots is calculated and compared with a desired value. If the calculated average is outside the predetermined permissible range, the angle data representative of the operating angle of the screw drive motor 240 are updated.

It will be understood from the foregoing descriptions of the first and second embodiments that the CCD camera 332 and a portion of the control device 350 assigned to implement steps S65, S74, S82, S107, S123 and S138 cooperate to constitute a delivery-amount detecting device operable to detect an amount of an adhesive agent delivered from the delivery nozzle 90, 160 onto the printed-wiring board 16. It will also be understood that the screw rotating deice 96, a portion of the control device 350 assigned to implement steps S67, S76, S84, S111, S115, S127, S131, S142 and S146, and the RAM 356 cooperate to constitute a pump control device operable to control the screw drive motor 240 of the screw pump 94 according to the angle data which are stored in the LARGE, MEDIUM and SMALL DELIVERY-AMOUNT memories and which represent the rotating angle of the screw 214. It will further be understood that a portion of the control device 350 assigned to implement step S201 constitutes a nozzle-rotation control device operable to control the nozzle rotating device 92, and that the heating and cooling devices 296, 298 and a portion of the control device 350 assigned to implement step S2 cooperate to constitute a gas-temperature control device which is operable to control the temperature of the compressed gas to be introduced into the air passage 294 and which cooperates with the air passage 294 to constitute the temperature control device 290 operable to control the temperature of the adhesive agent within the pump chamber 210 and the delivery nozzle 90, 160.

Figure 19:
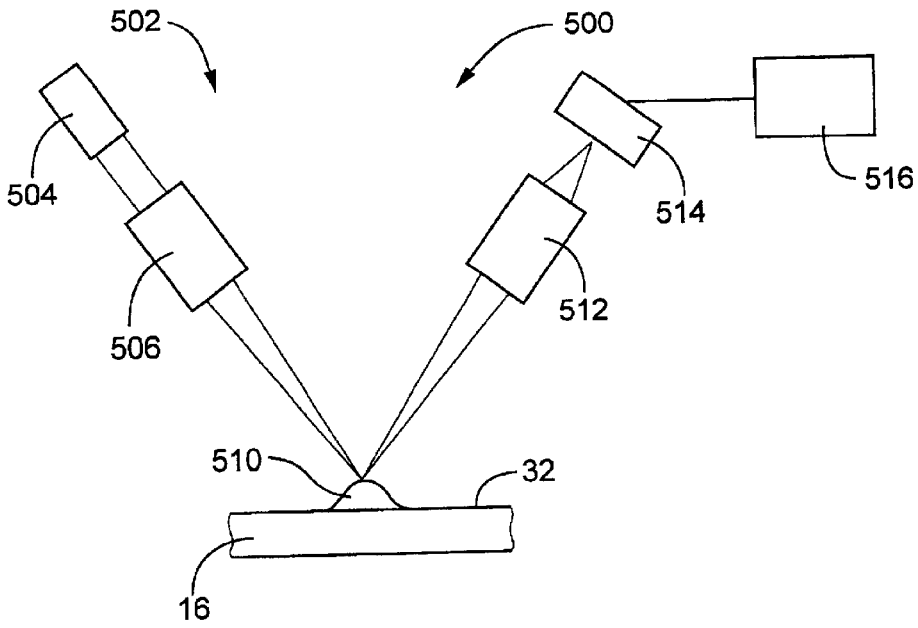
FIG. 19 is a front elevational view schematically showing a height detecting device of an adhesive delivery-amount detecting device of an adhesive applying apparatus according to a third embodiment of the present invention.

In the embodiments described above, the delivery amounts of the adhesive masses applied to the printed-wiring board 16 are detected by obtaining the surface areas of the outer profiles of the adhesive masses. However, the delivery amounts may be obtained on the basis of height dimensions of the adhesive masses as well as the surface areas of the outer profiles. This modification will be described as a third embodiment of this invention, referring to FIG. 19.

In the present embodiment, the Y-axis slide of the XY robot carries not only the CCD camera 332 but also a height detecting device 500 arranged to detect the height dimension of the adhesive mass applied to the printed-wiring board 16. The height detecting device 500 cooperates with the CCD camera 332 and the control device 350 to constitute the delivery-amount detecting device. The height detecting device 500 includes a laser displacement sensor 502, which in turn includes a laser beam generator 504 and a light-emitting system 506. The laser beam generator 504 generates a laser beam, which is condensed by the light-emitting system 506, so that a mass of an adhesive agent 510 (hereinafter referred to as "adhesive mass 510") printed on the working surface 32 of the board 16 is irradiated with the condensed laser beam emitted from the light-emitting system 506. The height detecting device 500 further includes a light-receiving system 512, a semiconductor position detecting element 514, and an analog arithmetic processing circuit 516. A portion of the light reflected by the adhesive mass 510 is incident upon the light-receiving system 512, and the light condensed by the light-receiving system 512 is incident upon the semiconductor position detecting element 514. On the basis of the output signal of the position detecting element 514, the analog arithmetic processing circuit 516 operates to calculate the height dimension of the adhesive mass 510. The focal point of the light incident upon the position detecting element 514 changes with the height of the adhesive mass 510, and the output signal of the position detecting element 514 changes with a change of the focal point, so that the height of the adhesive mass 510 can be obtained by processing the output signal of the position detecting element 514.

When the delivery amount of the adhesive mass 510 is detected, the CCD camera 332 is moved to a position right above the adhesive mass 510, and is operated to take the image of the adhesive mass 510. The height detecting device 500 is moved to a detecting position at which the central portion, namely, the crest or apex of the adhesive mass 510 is irradiated with the laser beam emitted from the light-emitting system 506. The movement of the height detecting device 500 to the detecting position is controlled according to position data representative of the coating position, and offset distances between the height detecting device 500 and the delivery nozzle. The surface area of the outer profile and the height of the adhesive mass 510 are obtained at each of a predetermined number of adhesive-applying spots, and the amount of delivery of the adhesive agent from the delivery nozzle is detected on the basis of the obtained surface area and height. A determination is made as to whether the thus detected delivery amount is held within a predetermined permissible range. For instance, an average of the surface areas at the predetermined number of adhesive-applying spots and an average of the height dimensions at the same adhesive-applying spots are obtained, and each of the obtained averages is compared with a desired value. If both of these two averages are held within respective permissible ranges determined by the desired values, the actual delivery amount of the adhesive agent is determined to be substantially equal to the desired value. In this case, the operating angle of the screw drive motor 240 is not adjusted. If at least one of the two averages is larger than the desired value by more than a predetermined amount, that is, than the upper limit of the permissible range, the operating angle of the screw drive motor 240 is reduced by an amount corresponding to the amount of excess of the delivery amount. If at least one of the two averages is smaller than the lower limit of the permissible range, the operating angle is increased by an amount corresponding to the amount of shortage of the delivery amount. If one of the two averages is smaller than the lower limit while the other is larger than the upper limit, the operating angle of the screw drive motor 240 is suitably adjusted according to a predetermined rule on the basis of the amount of excess and the amount of shortage of the delivery amount. The determination as to whether the detected actual delivery amount is substantially equal to the desired value may be made according to any other statistical processing technique.

In each of the illustrated embodiments, the screw pump 94 is used as a pump device for delivering the adhesive agent. However, the pump device may be a gear pump. This modification will be briefly described as a fourth embodiment of this invention, referring to FIG. 20.

Figure 20:
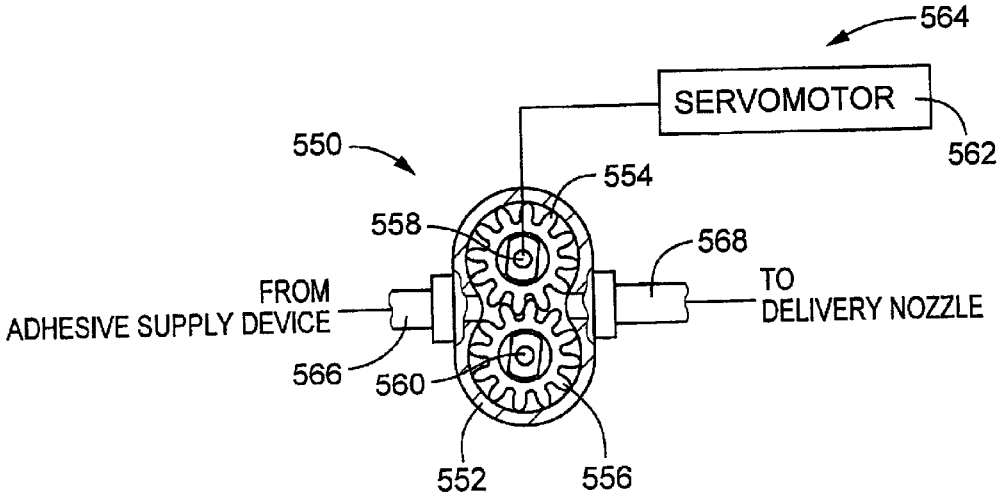
FIG. 20 is a front elevational view partly in cross section schematically showing a gear pump of an adhesive applying apparatus according to a fourth embodiment of this invention.

The gear pump used in the present embodiment is indicated generally at 550 in FIG. 20. The gear pump 550 includes a pump housing 552, and two gears 554, 556 which are rotatably disposed within the pump housing 552 and which mesh with each other. The gears 554, 556 have respective gear shafts 558, 560, and the gear shaft 558 is rotated by a pump drive device 564 which includes as a drive source an electric motor in the form of a servomotor 562. With the gear shaft 558 rotated by the pump drive device 564, the two gears 554, 556 are rotated in meshing engagement with each other, so that an adhesive agent is sucked into the interior of the pump housing 552 through a suction passage 566 connected to the adhesive supply device, and is delivered to the delivery nozzle through a delivery passage 568. The servomotor 562 is controlled by a control device (not shown) to rotate the gears 554, 556 by an angle suitable for delivering a desired amount of adhesive agent onto the printed-wiring board 16.

The space between the pump housing 552 and the gears 554, 556, and the suction and delivery passages 566, 568 are filled with the adhesive agent without air cavities therein, so that the amount of the adhesive agent to be delivered from the delivery passage 568 onto the printed-wiring board 16 accurately corresponds to the rotating angle of the gears 554, 556. Accordingly, the desired amount of adhesive agent can be delivered onto the board 16 by controlling the rotating angle of the gears 554, 556 by controlling the operating angle of the servomotor 562. As in the preceding embodiments, the delivery amount of the adhesive masses applied to the board 16 is detected on the basis of images of the adhesive masses, to determine whether the detected delivery amount is held within a predetermined permissible range. The operating angle of the servomotor 562 is adjusted to adjust the rotating angle of the gears 554, 556 by an amount corresponding to a difference between the actual delivery amount and the desired value. In the present fourth embodiment, the pump rotating device 564 and a portion of a computer of the control device assigned to control the servomotor 562 cooperate to constitute the pump control device.

While the first and second embodiments of FIGS. 3 and 4 are arranged such that the screw 214 of the screw pump 94 is rotated relative to the stationary pump housing 180, the pump housing may be rotated relative to the stationary screw. This modification will be described as a fifth embodiment of this invention, referring to FIG. 21. In this embodiment, a screw 604 of a screw pump 602 is fixed to a syringe 600 which serves as a container for accommodating a mass of a highly viscous fluid in the form of an adhesive agent. On the other hand, a pump housing 606 is rotatably mounted on a Z-axis slide 608 which is a part of a body of an adhesive applying apparatus of an adhesive applying system.

The syringe 600, which is a generally cylindrical member, is held by the Z-axis slide 608 such that the centerline of the syringe 600 extends in the vertical direction. The Z-axis slide 608 includes a syringe holding portion 610 while the syringe 600 has an engaging portion 612 engageable with the syringe holding portion 610. The syringe holding portion 610 and the engaging portion 612 are formed so as to permit axial movement and rotation of the syringe 600 relative to the syringe holding portion 610, in a predetermined first relative angular position or phase of the syringe holding portion 610 and engaging portion 612. In this relative angular position, the syringe 600 is first axially moved downwards such that the engaging portion 612 is fitted in the syringe holding portion 610, and is then rotated by a given angle relative to the syringe holding portion 610, to a predetermined second relative angular position in which the axial movement of the syringe 600 is prevented to prevent removal of the syringe 600 from the syringe holding portion 610. Thus, the syringe 600 can be easily mounted on the Z-axis slide 608 through the syringe holding portion 610 and the engaging portion 612. The removal of the syringe 600 from the Z-axis slide 608 can be easily achieved by first rotating and then axially moving the syringe 600.

The syringe 600 is provided at its lower end with a cylindrical portion 614 in which there is fixedly fitted a proximal or upper end portion of the screw 604. The cylindrical portion 614 is fixed to the upper end portion of the screw 604 with a suitable bonding agent such that the screw 604 extends downwards from the lower end of the syringe 600, coaxially with the syringe 600. The cylindrical portion 614 has an opening 616 formed in its radial direction through the cylindrical wall, at an axial part thereof located above the lower end part in which the upper end portion of the screw 604 is fixed. The adhesive agent accommodated in the syringe 600 flows through this opening 516 out of the syringe 600.

On the Z-axis slide 608, there is rotatably mounted a nozzle holding member 620 through a bearing 622. A delivery nozzle 624 is removably attached to a lower end portion of the nozzle holding member 620. Within the nozzle holding member 620, there is rotatably supported the pump housing 606 through a bearing 626. The delivery nozzle 624 includes a nozzle body 628 and a delivery tube 630, and the lower end portion of the pump housing 606 is fluid-tightly and rotatably fitted in the nozzle body 628. When the syringe 600 is mounted on the Z-axis slide 608, the cylindrical portion 614 is fitted into the pump housing 606, such that the opening 616 formed through the cylindrical portion 614 is open to the interior of the pump housing 606. The nozzle body 628 is provided with a pin 632 extending parallel to the delivery tube 630. The pin 632 functions as a gap-defining portion for maintaining a gap between the lower end of the delivery tube 630 and the printed-wiring board.

The nozzle holding member 620 has an integrally formed driven gear 640, which is rotated via a drive gear 642 by a nozzle rotating motor 644. The delivery nozzle 624 is rotated by a desired angle by the nozzle rotating motor 644, which is a servomotor. The driven gear 640, drive gear 642 and nozzle rotating motor 644 cooperate to constitute a major part of a nozzle rotating device operable to rotate the delivery nozzle 624. The pump housing 606 also has an integrally formed driven gear 648, which is rotated via a drive gear 650 by a pump drive motor 652. The pump housing 606 is rotated by a desired angle by the pump drive motor 652, which is also a servomotor. The driven gear 648, drive gear 650 and pump drive motor 652 cooperate to constitute a major part of a pump drive device.

Figure 21:
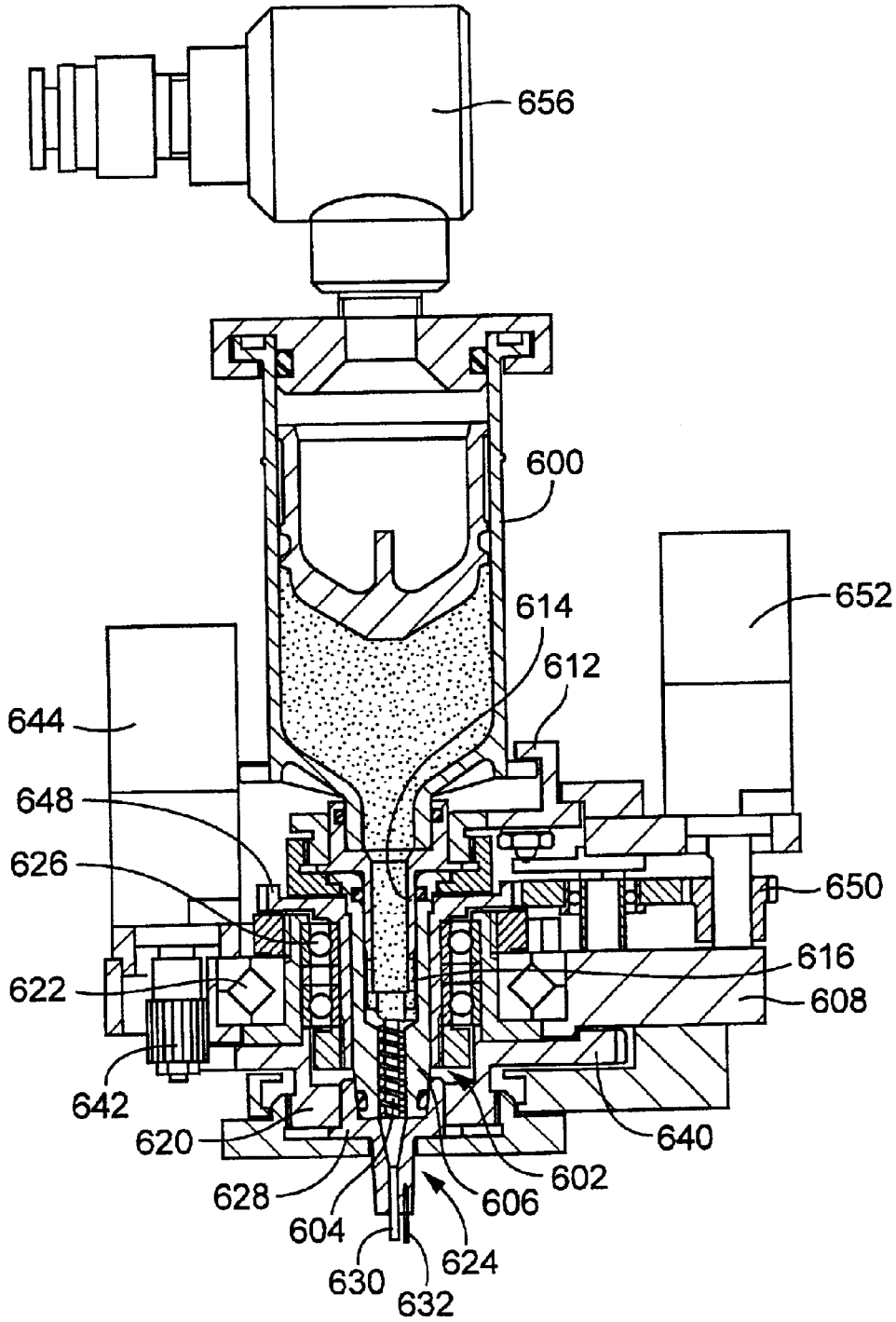
FIG. 21 is a front elevational view partly in cross section of an adhesive applying apparatus according to a fifth embodiment of this invention.

In the present adhesive applying system of FIG. 21, the syringe 600 is mounted and removed on and from the Z-axis slide 608, together with the screw 604 of the screw pump 602. The screw 604 is fitted into the pump housing 606 when the syringe 600 is mounted on the Z-axis slide 608, and is removed from the pump housing 606 when the syringe 600 is removed from the Z-axis slide 608. Since the screw 604 is held stationary, that is, need not be rotated, it can be easily mounted and removed on and from the Z-axis slide 608, together with the syringe 600. After the syringe 600 is mounted on the Z-axis slide 608, the screw pump 602 is directly connected to the syringe 600, so that the syringe 600 and the screw pump 602 need not be connected to each other through a supply passage, as in the preceding embodiments. This arrangement permits an accurate control of the delivery amount of the adhesive agent.

Described in detail, the syringe 600 is connected to a compressed-air supply device (not shown) through a pipe joint 656 and a hose (not shown). When the screw pump 602 is operated, the syringe 600 is supplied with compressed air, so that the compressed air assists the screw pump 602 to deliver the adhesive agent. Owing to the direct connection of the screw pump 602 to the syringe 600, a resistance to a flow of the adhesive agent from the syringe 600 to the screw pump 602 is relatively low, and the amount of elastic deformation of the adhesive agent is relatively small, permitting the supply of the adhesive agent from the syringe 600 to the screw pump 602 immediately after the supply of the compressed air to the syringe 600 is initiated, and permitting the termination of the supply of the adhesive agent to the screw pump 602 immediately after the supply of the compressed air is stopped. The pump control device indicated above is arranged to rotate the screw pump 602 in the reverse direction by a predetermined angle when the screw pump 602 is turned off. This arrangement permits an accurate control of the amount of delivery of the adhesive agent from the delivery nozzle 624.

The present adhesive applying system includes a synchronous control device, which may be arranged to control the pump drive motor 652 and the compressed-air supply device such that the screw pump 602 and the compressed-air supply device are operated in synchronization with each other. Alternatively, a computer of the synchronous control device may be adapted to control the moments at which the compressed-air supply device is turned on and off, such that those moments are advanced or delayed, as needed, with respect to the moments at which the pump drive motor 652 is turned on and off. The computer may be arranged to control pressure of the compressed air.

The delivery amount of the adhesive agent may be detected on the basis of only the height dimension of the adhesive mass applied to the printed-wiring board.

The delivery amount of the adhesive agent may be detected on the basis of volume of the adhesive agent applied to the board. The volume of the adhesive agent may be obtained on the basis of an average of the height dimensions of adhesive masses applied at a plurality of adhesive-applying spots on the printed-wiring board, and an average of the surface areas of the outer profiles of those adhesive masses. Alternatively, the volume may be obtained on the basis of a plurality of images of an adhesive mass applied to the printed-wiring board, which are taken by a two-dimensional image-taking system as disclosed in co-pending U.S. patent application Ser. No. 09/634,257 filed Aug. 7, 2000. The image-taking system includes a light source device or illuminating device capable of emitting through a slit a planar light along a straight plane inclined with respect to the working surface of the printed-wiring board, so that a portion of a highly viscous fluid mass applied to the working surface is irradiated with a band of light. The light source device is moved relative to the board in the XY plane parallel to the working surface of the board. The image-taking system further includes a two-dimensional image-taking device which is disposed such that its optical axis intersects the optical axis of the light source device. The image-taking device is also moved relative to the printed-wiring board in the XY plane. During the movements of the light source device and the image-taking device relative to the applied fluid mass, a plurality of two-dimensional images taken each along the band of light by the image-taking device, when the moving band of light is located at respective positions. Since the plane of the planar light is inclined with respect to the working surface of the printed-wiring board, images of the outer profiles of the fluid mass in a cross sectional plane parallel to the plane of the planar light may be obtained from the two-dimensional images, so that the volume of the adhesive mass can be obtained by processing the two-dimensional images.

The image-taking device may be a line sensor having a straight array of a multiplicity of light-sensitive elements. The straight array is moved relative to an object, to take a plurality of line images which collectively define a two-dimensional image of the object.

The delivery nozzles 90 and 160 used in the illustrated embodiments have the single delivery tube 106 and the two delivery nozzles 162, respectively. However, the highly-viscous-fluid supply device may use a delivery nozzle having three or more delivery tubes.

The adhesive supply device 98 and the screw pump 94 may be disposed so as to permit an axial relative movement thereof, and such that the adhesive supply device 98 is not axially moved relative to the Z-axis slide 70 when the delivery nozzle 90, 160 and the screw pump 94 are axially moved relative to the Z-axis slide 70 after the pin 110, 172 has come into abutting contact with the printed-wiring board 16.

The arrangement to introduce the compressed air into the upper air chamber of the container 250 or syringe 600 is not essential. That is, the adhesive supply device need not be a pressurizing type.

The temperature control device to control the temperature of the adhesive agent is not essential, either, and may include at least one of the heating and cooling devices 296, 298.

At least one of the air pressure regulating devices 273, 300 of the adhesive supply device and the temperature control device may be eliminated.

In the illustrated embodiments, the angle data representative of the operating angle of the screw drive motor 240 or gear drive servomotor 562 are updated to adjust the operating angle. However, angle-adjusting data representative of an amount of change (amount of increase or decrease) of the operating angle with respect to the present value or a predetermined reference value may be obtained, rather than changing the angle data representative of the angle of operation of the motor 240, 562. The present value of the operating angle is the operating angle at which the delivery amount of the adhesive mass has been detected to determine whether the actual delivery amount is substantially equal to the desired value. The reference value of the operating angle may be the predetermined desired value or initial value which is used in the first coating operation on the first board. In the illustrated embodiments, the angle data which represent the initial value and which are stored in the first memory area of the DELIVERY-AMOUNT memory are replaced by the angle data representative of the adjusted operating angle of the motor 240, 562. However, the angle data stored in the first memory area may be retained, so that the operating angle of the motor 240, 562 can be controlled to the initial value, as needed, for instance, when the coating operation is resumed after the adhesive applying device is kept at rest for a relatively long time.

The dispenser unit may be provided with a plurality of delivery nozzles which have respective different delivery tubes and which are selectively used for respective coating operations on the same printed-wiring board. For instance, the delivery nozzle having a single delivery tube is used for some of the adhesive-applying spots, and the delivery nozzle having two or more delivery tubes is used for the other of the adhesive-applying spots.

The adhesive masses at selected ones or all of the adhesive-applying spots may be imaged to detect the delivery amount after the adhesive masses have been applied to all of the adhesive-applying spots on the board 16. Alternatively, the adhesive masses are first applied to all of the adhesive-applying spots at which the delivery amounts are to be detected, and then these adhesive masses are imaged before the adhesive masses are applied to the other adhesive-applying spots on the board.

The numbers of the adhesive-applying spots at which the delivery amounts of the adhesive masses are to be detected on different types of the board may be determined depending upon the coating mode (selected one of the large-, medium- and small-amount coating mode) and the total number of the adhesive-applying spots in the selected coating mode.

In the illustrated embodiments, the operating angle of the servomotor to rotate the screw of the screw pump or the gears of the gear pump is adjusted to adjust the actual delivery amount of the adhesive agent to the desired value if the detected actual delivery amount is outside the predetermined permissible range. The operating angle of the servomotor is one of operating conditions of the adhesive applying apparatus. However, the delivery amount may be adjusted by adjusting the temperature of the adhesive agent, in place of, or in addition to the operating angle of the servomotor.

Further, it is possible that the highly-viscous-fluid applying apparatus is moved by a suitable moving device in one of the X-axis and Y-axis directions parallel to the working surface of an object, while the object is moved by another moving device in the other of the X-axis and Y-axis directions. Further alternatively, the highly-viscous-fluid applying apparatus may be fixed in position. In this case, the object is moved by a moving device in the XY plane, relative to the highly-viscous-fluid applying apparatus, so that the adhesive agent is applied to predetermined adhesive-applying spots on the object.

The highly-viscous-fluid applying apparatus may be arranged to apply a highly viscous fluid to the object, such that the applied adhesive masses take the form of relatively elongate strips, rather than a generally circular shape when viewed in the direction perpendicular to the working surface of the object. In this case, the delivery nozzle and the object are moved relative to each other in a plane parallel to the working surface, while the pump is operated to delivery the adhesive agent.

It is to be understood that the present invention may be embodied with various other changes, modifications and improvements, such as those described in the SUMMARY OF THE INVENTION, which may occur to those skilled in the art, without departing from the spirit and scope of the invention defined in the following claims:

What is claimed is:

1. A highly-viscous-fluid applying apparatus comprising:

a fluid supply device operable to supply a highly viscous fluid;

a delivery nozzle from which the highly viscous fluid is delivered;

a screw pump disposed between said fluid supply device and said delivery nozzle, and including a stationary screw that is non-rotatable, and a rotatable pump housing having a screw chamber of a circular shape in transverse cross section, said rotatable rump housing accommodating said stationary screw substantially fluid-tightly and being rotatable about an axis of said stationary screw, said screw being operable to deliver the highly viscous fluid received from said fluid supply device, from said delivery nozzle, by rotation of said rotatable pump housing about the axis of said stationary screw; and a pump control device including a pump drive device operable to rotate said rotatable pump housing about the axis of said stationary screw to deliver said highly viscous fluid from said delivery nozzle.

2. A highly-viscous-fluid applying apparatus according to claim 1, wherein said delivery nozzle extends from one end of said screw pump, coaxially with said screw pump.

3. A highly-viscous-fluid applying apparatus according to claim 1, wherein said fluid supply device is a fluid supply device of a pressurizing type arranged to pressurize the highly viscous fluid and feed the pressurized highly viscous fluid to said screw pump.

4. A highly-viscous-fluid applying apparatus according to claim 3, wherein said fluid supply device of the pressurizing type includes:

a container accommodating a mass of the highly viscous fluid;

a compressed-air supply device operable to introduce a compressed air into an upper air chamber in said container; and a supply passage connecting a lower end of said container and a first end portion of said screw pump opposite to a second end portion of said screw pump from which said delivery nozzle extends.

5. A highly-viscous-fluid applying apparatus according to claim 1, wherein said fluid supply device includes a stationary container for accommodating a mass of the highly viscous fluid, said stationary container including a supply portion having an opening from which the highly viscous fluid is supplied, and said stationary screw is fixed to and coaxial with said supply portion of said stationary container.

6. A highly-viscous-fluid applying apparatus according to claim 5, wherein said stationary container further includes a body portion coaxial with said supply portion and said stationary screw of said screw pump.

7. A highly-viscous-fluid applying apparatus according to claim 1, further comprising a delivery-amount detecting device operable to detect an amount of delivery of the highly viscous fluid from said delivery nozzle onto an object, and said pump control device controls said pump drive device such that the amount of delivery of the highly viscous fluid detected by said delivery-amount detecting device is adjusted to a desired value.

8. A highly-viscous-fluid applying apparatus according to claim 1, further comprising a gap-defining portion which is disposed so as to extend in a direction of extension of the delivery nozzle, in the vicinity of the delivery nozzle as seen in a direction perpendicular to said direction of extension, such that a free end of said gap-defining portion is located ahead of a free end of the delivery nozzle in said direction of extension and such that said gap-defining portion is moved with the delivery nozzle in said direction of extension, for abutting contact with a working surface of an object, to maintain a predetermined gap between said free end of said gap-defining portion and said working surface.

9. A highly-viscous-fluid applying apparatus according to claim 8, further comprising a machine frame, a biasing device and a stopper device, and wherein at least said delivery nozzle and said gap-defining portion are movable relative to said machine frame in an axial direction of said delivery nozzle, and are biased by said biasing device in said axial direction from a proximal end toward a delivery end of said delivery nozzle, said gap-defining portion and said delivery nozzle being normally held under a biasing action of said biasing device, at respective positions which are determined by said stopper device.

10. A highly-viscous-fluid applying apparatus according to claim 1, further comprising a temperature control device operable to control a temperature of a mass of the highly viscous fluid, at least at a portion of the mass which is moved through said delivery nozzle for delivery thereof onto an object.

11. A highly-viscous-fluid applying apparatus according to claim 10, wherein said temperature control device has:

a gas passage through which a gas is circulated for heat transfer between said gap and a portion of said rotatable pump housing which surrounds said stationary screw; and a gas-temperature control device operable to control a temperature of said gas is circulated through said gas passage.

12. A highly-viscous-fluid applying apparatus according to claim 1, wherein said delivery nozzle has a plurality of delivery tubes parallel to each other.

13. A highly-viscous-fluid applying apparatus according to claim 12, further comprising a nozzle rotating device operable to rotate said delivery nozzle about an axis thereof which is parallel to said plurality of delivery tubes.

14. A highly-viscous-fluid applying apparatus according to claim 13, further comprising a controller operable to control said nozzle rotating device according to a predetermined control program.

15. A highly-viscous-fluid applying apparatus according to claim 1, further comprising a support member which supports at least said delivery nozzle and said screw pump, and a relative-movement device operable to move said support member and an object relative to each other in a direction parallel to a working surface of said object on which the highly viscous fluid is delivered from said delivery nozzle, and in a direction perpendicular to said working surface.

16. A highly-viscous-fluid applying apparatus according to claim 1, wherein said fluid supply device is a fluid supply device of a pressurizing type arranged to pressurize the highly viscous fluid and feed the pressurized highly viscous fluid to said screw pump, said apparatus further comprising a synchronous controller operable to operate said fluid supply device of the pressurizing type, in synchronization with an operation of said screw pump under the control of said pump control device.

17. A highly-viscous-fluid applying apparatus according to claim 1, wherein said pump control device includes a reverse-operating portion operable to operate said pump by a predetermined amount in a reverse direction opposite to a forward direction after termination of an operation of said pump in said forward direction to feed the highly viscous fluid to said delivery nozzle.

18. A highly-viscous-fluid applying apparatus comprising:

a fluid supply device operable to supply a highly viscous fluid;

a delivery nozzle from which the highly viscous fluid is delivered;

a screw pump disposed between said fluid supply device and said deliver nozzle, and including a stationary screw that is non-rotatable, and a rotatable pump housing having a screw chamber of a circular share in transverse cross section, said rotatable pump housing accommodating said stationary screw substantially fluid-tightly and being rotatable about an axis of said stationary screw, said screw pump being operable to deliver the highly viscous fluid received from said fluid supply device, from said delivery nozzle, by rotation of said rotatable pump housing about the axis of said stationary screw;

a pump control device including a pump drive device operable to rotate said rotatable pump housing about the axis of said stationary screw, to deliver said highly viscous fluid from said delivery nozzle; and a machine frame, wherein said fluid supply device includes a stationary container for accommodating a mass of the highly viscous fluid, said stationary container including a supply portion having an opening from which the highly viscous fluid is supplied, said stationary screw being fixed to and coaxial with said supply portion of said stationary container, and wherein said rotatable pump housing is held by the machine frame rotatably and axially immovably relative to said machine frame, and said stationary container is removably mounted on said machine frame, said stationary screw being fitted into said rotatable pump housing as said stationary container is mounted on the machine frame, and removed from the rotatable pump housing as the stationary container is removed from the machine frame.

19. A highly-viscous-fluid applying apparatus according to claim 18, wherein said supply portion of said container consists of a cylindrical portion extending from one end a body of said stationary container, and said stationary screw is fixedly fitted at a proximal end thereof in a first part of said cylindrical portion, said opening being formed through a second part of said cylindrical portion which is located nearer to said body than said first part.

20. A highly-viscous-fluid applying apparatus according to claim 18, further comprising a nozzle holding member mounted on the machine frame, and wherein said delivery nozzle is rotatably held by said nozzle holding member.

21. A highly-viscous-fluid applying apparatus according to claim 20, further comprising a nozzle rotating device operable to rotate said delivery nozzle relative to said stationary container and said machine frame.

22. A highly-viscous-fluid applying apparatus according to claim 18, further comprising a machine frame, and wherein said rotatable pump housing and said delivery nozzle are rotatably held by the machine frame, and said rotatable pump housing is rotatably fitted in said delivery nozzle.

23. A highly-viscous-fluid applying apparatus according to claim 18, wherein said stationary container further includes a body portion coaxial with said supply portion and said stationary screw of said screw pump.

* * * * *